US009368123B2

(12) United States Patent
Srinivasan et al.

(10) Patent No.: US 9,368,123 B2
(45) Date of Patent: Jun. 14, 2016

(54) METHODS AND APPARATUS TO PERFORM AUDIO WATERMARK DETECTION AND EXTRACTION

(71) Applicants: Venugopal Srinivasan, Palm Harbor, FL (US); Alexander Topchy, New Port Richey, FL (US)

(72) Inventors: Venugopal Srinivasan, Palm Harbor, FL (US); Alexander Topchy, New Port Richey, FL (US)

(73) Assignee: THE NIELSEN COMPANY (US), LLC, New York, NY (US)

( * ) Notice: Subject to any disclaimer, the term of this patent is extended or adjusted under 35 U.S.C. 154(b) by 705 days.

(21) Appl. No.: 13/653,001

(22) Filed: Oct. 16, 2012

(65) Prior Publication Data

US 2014/0105448 A1 Apr. 17, 2014

(51) Int. Cl.
*G10L 19/018* (2013.01)

(52) U.S. Cl.
CPC ..... *G10L 19/018* (2013.01)

(58) Field of Classification Search
USPC ..... 704/273, 500–504
See application file for complete search history.

(56) References Cited

U.S. PATENT DOCUMENTS

| | | | | |
|---|---|---|---|---|
| 6,104,826 | A | 8/2000 | Nakagawa et al. | |
| 6,285,775 | B1 | 9/2001 | Wu et al. | |
| 6,704,869 | B2 | 3/2004 | Rhoads et al. | |
| 7,062,069 | B2 | 6/2006 | Rhoads | |
| 7,269,734 | B1 | 9/2007 | Johnson et al. | |
| 7,319,791 | B1 | 1/2008 | Baldo et al. | |
| 7,389,420 | B2 | 6/2008 | Tian | |
| 7,424,132 | B2 | 9/2008 | Rhoads | |
| 8,027,510 | B2 | 9/2011 | Rhoads | |
| 8,768,710 | B1 * | 7/2014 | Blesser | 704/273 |
| 2002/0009208 | A1 * | 1/2002 | Alattar et al. | 382/100 |
| 2003/0028796 | A1 | 2/2003 | Roberts et al. | |
| 2003/0177359 | A1 * | 9/2003 | Bradley | 713/172 |

(Continued)

FOREIGN PATENT DOCUMENTS

| | | |
|---|---|---|
| EP | 2439735 | 4/2012 |
| EP | 2487680 | 8/2012 |
| JP | 2012-37701 | 2/2012 |

OTHER PUBLICATIONS

International Searching Authority, "International Search Report and Written Opinion of the International Searching Authority," issued in connection with application No. PCT/US2013/060187, mailed on Dec. 19, 2013 (11 pages).

(Continued)

*Primary Examiner* — Abul Azad
(74) *Attorney, Agent, or Firm* — Hanley, Flight & Zimmerman, LLC.

(57) ABSTRACT

Methods and apparatus to perform audio watermark detection and extraction are disclosed. An example method includes sampling a media signal to generate samples, wherein the media signal includes an embedded message, determining a first symbol value for a first block of the samples, determining a second symbol value for a second block of the samples, and determining, using a processor, a resulting symbol value, representative of a part of the embedded message, based on the first symbol value and the second symbol value for the first block of samples and the second block of samples, wherein the first block and the second block partially overlap.

23 Claims, 17 Drawing Sheets

(56) References Cited

U.S. PATENT DOCUMENTS

| | | | | |
|---|---|---|---|---|
| 2007/0217626 | A1* | 9/2007 | Sharma et al. | 381/100 |
| 2010/0106510 | A1* | 4/2010 | Topchy et al. | 704/500 |
| 2010/0158160 | A1 | 6/2010 | Mukkavilli et al. | |
| 2011/0264455 | A1 | 10/2011 | Nelson et al. | |
| 2013/0171926 | A1 | 7/2013 | Perret et al. | |

OTHER PUBLICATIONS

European Patent Office, "Communication pursuant to Rules 161 and 162 EPC", issued in connection with Application No. 13846852.5, issued on Jun. 10, 2015, 3 pages.

IP Australia, "Patent Examination Report", issued in connection with Australian Patent Application No. 2013332371, dated Aug. 10, 2015, 3 pages.

* cited by examiner

METHODS AND APPARATUS TO PERFORM AUDIO WATERMARK DETECTION AND EXTRACTION

FIELD OF THE DISCLOSURE

This disclosure relates generally to identifying media, and, more particularly, to methods and apparatus for performing audio watermark detection and extraction.

BACKGROUND

Systems for identifying media (e.g., television (TV) programs, radio programs, commentary, audio/video content, movies, commercials, advertisements, etc.) are useful for determining the identity, source, etc. of presented or accessed media in a variety of media monitoring systems. In some systems, a code is inserted into the audio or video of the media and the code is later detected at one or more monitoring sites when the media is presented. The information payload of the code embedded into the media can include program identification information, source identification information, time of broadcast information, etc. In some examples, the code is implemented as an audio watermark encoded in an audio portion of the media. Information may additionally or alternatively be included in a video portion of the media, in metadata associated with the media, etc.

Monitoring sites may include locations such as, households, stores, places of business and/or any other public and/or private facilities where media exposure and/or consumption of media is monitored. For example, at an example monitoring site, codes from the audio and/or video are captured and stored. The collected codes may then be sent to a central data collection facility for analysis. In some examples, the central data collection facility, a content provider, or another source may also send secondary media associated with the monitored media to the monitoring site (e.g., to a secondary media presentation device).

DETAILED DESCRIPTION

Figure 1:
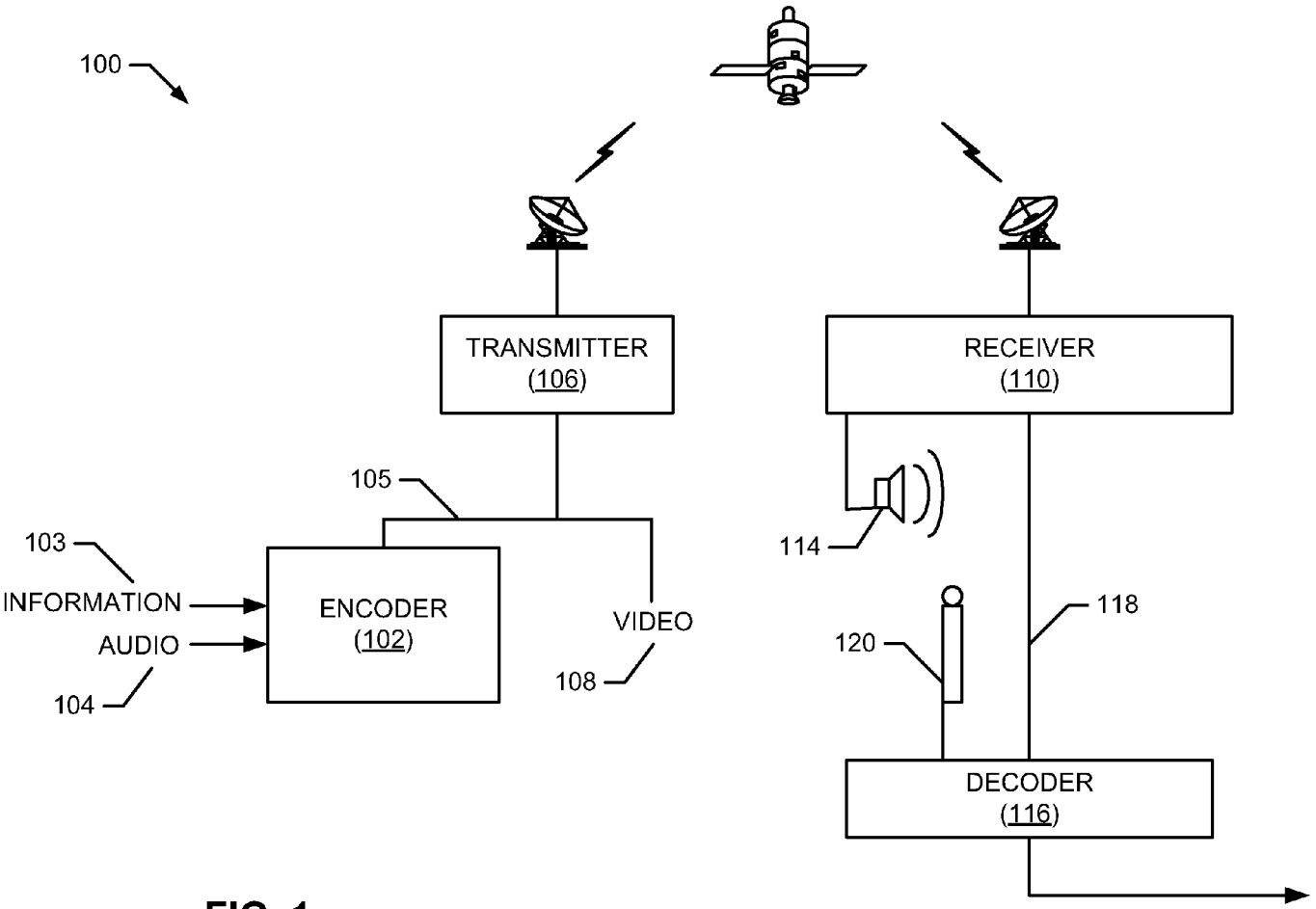
FIG. 1 is a block diagram of an example system constructed in accordance with the teachings of this disclosure for identifying media.

In audience measurement systems in which identification information (e.g., a code) is embedded in media (e.g., an audio signal), recovery of the identification information is dependent on the fidelity with which the media is received at the media monitoring site. For example, where the information is embedded by modifying the frequency spectrum of an audio signal, recovery of the code is dependent upon the frequency spectrum being received with sufficient quality to detect the modifications. Interference due to multi-path interference, data transmission interference, sampling artifacts, conversion artifacts, ambient noise, etc. can make it difficult to detect the embedded information. For example, if a microphone is used to receive an encoded audio signal output by a speaker, people talking near the microphone will influence the frequency spectrum of the audio signal. Interference with an audio signal is often transient and may only affect portions of the audio signal.

Psycho-acoustic masking performed during encoding that attempts to hide the embedded information in the audio to prevent human perception may further complicate decoding of information from audio. In instances where the audio track is quiet or silent, the amplitude of the modifications to the frequency spectrum may be reduced to a point at which detection is difficult or even impossible. In such instances, the effects of interference are further increased. However, in some instances such quiet or silent periods are also transient. For example, speech comprises bursts of audio separated by brief pauses.

In some instances, the code/watermark and/or the information is represents is used to trigger presentation of additional media (e.g., secondary media presented on a secondary media presentation device such as an iPad®) as discussed in U.S. patent application Ser. No. 12/771,640 published as US Patent Publication No. 2010/0280641, which is hereby incorporated by reference in its entirety. Therefore, it is desirable to increase the reliability of detection and facilitate consistent detection even when noise, quiet audio, etc. complicate the decoding process.

The following description makes reference to encoding and decoding that is also commonly known as watermarking and watermark detection, respectively. Such watermarking may be performed with audio or video. It should be noted that in this context, audio may be any type of signal having a frequency falling within the normal human audibility spectrum. For example, audio may be speech, music, an audio portion of an audio and/or video program or work (e.g., a television program, a movie, an Internet video, a radio program, a commercial, etc.), a media program, noise, and/or any other sound.

In general, the encoding of codes in audio involves inserting one and/or more codes or information (e.g., watermarks) into the audio and, ideally, making the code inaudible to hearers of the audio. However, there may be certain situations in which the code may be audible to certain listeners. As described in detail below, the codes or information to be inserted into the audio may be converted into symbols that will be represented by code frequency signals to be embedded in the audio to represent the information. The code frequency signals include one or more code frequencies, wherein different code frequencies or sets of code frequencies are assigned to represent different symbols of information. Any suitable encoding or error correcting technique may be used to convert codes into symbols.

By controlling the amplitude at which these code frequency signals are input into the native audio, the of the code frequency signals can be made imperceptible to human hearing when the audio in which the code(s) are embedded is played. Accordingly, in some examples, masking operations based on the energy content of the native audio at different frequencies and/or the tonality or noise-like nature of the native audio are used to provide information upon which the amplitude of the code frequency signals is based.

Additionally, it is possible that an audio signal has passed through a distribution chain. For example, the media may pass from a media originator to a network distributor (e.g., NBC national) and further passed to a local media distributor (e.g., NBC in Chicago). As the audio signal passes through the distribution chain, one of the distributors may encode a watermark into the audio signal in accordance with the techniques described herein, thereby including in the audio signal an indication of identity of that distributor or the time of distribution. The encoding described herein is very robust and, therefore, codes inserted into the audio signal are not easily removed.

To facilitate reliable and consistent decoding, an example system disclosed herein performs code detection by performing message-region analysis (e.g., analyzing multiple blocks of samples in a vicinity such as blocks of samples that are overlapping and offset by number of samples that is less than the number of samples in a block) on a digitally sampled audio signal. Such decoding takes advantage of the repetition or partial repetition of codes within a signal and/or the fact that portions of a code are embedded over a period of time (e.g., symbols of a message may be embedded in 200 milliseconds of an audio signal during which the multiple attempts at extracting the same symbol can be performed). Accordingly, as disclosed in further detail herein, a decoder selects an initial long block (e.g., a block of samples having a length matching a number of samples previously used by an encoder to encode a symbol) of sampled audio data from which to extract a symbol value. The decoder decodes the initial long block to determine a symbol encoded in the initial long block. The decoder then decodes the symbols identified for a plurality of long blocks preceding and partially overlapping the initial long block. These symbols may have already been extracted by the decoder (e.g., when processing those long blocks as the currently received long block). The overlapping long blocks of samples are in very close proximity in time to the initial long block of samples (thus, within the same message-region) and will likely contain the same symbol value as the initial long block of samples. For example, as described in conjunction with FIGS. 8, 9, and 10, the initial long block of samples may comprise the most recently sampled 3072 samples and a first, prior long block of samples may comprise 3072 samples starting 16 samples prior to the initial long block and excluding the 16 most recently received samples (e.g., a window shifted 16 samples earlier in time).

The decoder may then additionally or alternatively select corresponding message-regions a multiple of a message length of samples earlier in time (as described in conjunction with FIG. 8) from which to select a plurality of overlapping long blocks of samples from which symbol values are extracted. For example, the same message may be repeated (or substantially repeated (e.g., a varying portion such as a timestamp)) every message length, may be repeated every three message lengths, etc.

Once the plurality of symbols is collected, the symbols are compared to determine a resulting symbol associated with the initial block of samples. For example, a voting scheme may be used to determine the most occurring symbol from the results. By using voting or another technique that compares the multiple symbols, the likelihood that interference or masking will prevent symbol extraction is reduced. Transient interference or dropout that affects a minority portion of the symbol extractions will, thus, not prevent symbol decoding.

FIG. 1 is a block diagram of an example system 100 constructed in accordance with the techniques of this disclosure for identifying media. The example system 100 may be, for example, a television audience measurement system, which is described by way of example herein. Alternatively, the system 100 may be any other type of media system. The example system 100 of FIG. 1 includes an encoder 102 that adds information 103 to an input audio signal 104 to produce an encoded audio signal 105.

The information 103 may be any information to be associated with the audio signal 104. For example, the information 103 may be representative of a source and/or identity of the audio signal 104 or a media program associated with the audio signal (e.g., a media program that includes the audio signal 104 and the video 108). The information 103 may additionally or alternatively include timing information indicative of a time at which the information 103 was inserted into the audio and/or a media broadcast time. The information 103 may also include control information to control the behavior of one or more target devices that receive the encoded audio signal 105. The audio signal 104 may be any type of audio including, for example, voice, music, noise, commercial advertisement audio, audio associated with a television program, live performance, etc. While the example system 100 utilizes an audio signal, any other type of signal may additionally or alternatively be utilized.

The example encoder 102 of FIG. 1 may employ any suitable method for inserting the information 103 in the audio signal 104. The encoder 102 of the illustrated example inserts one or more codes representative of the information 103 into the audio signal 104 to create the encoded audio 105. The example encoder 102 inserts codes into the audio signal 104 by modifying frequency components of the audio signal 104 (e.g., by combining the audio signal 104 with sine waves at the frequencies to be modified, by using Fourier coefficients in the frequency domain to adjust amplitudes of certain frequencies of audio, etc.) based on a look-up table of frequency components and symbols. In particular, the encoder 102 of the illustrated example samples the audio signal 104 at 48 kilohertz (KHz). Each message comprises a synchronization symbol following by 49 bits of information represented by 7 symbols of 7 bits per symbol. In the example of FIG. 1, each symbol of a message (including the synchronization symbol) is carried in 9216 samples (a "long block") of audio at 48 KHz, which corresponds to 192 milliseconds of audio. Thus, each message is encoded in 9216×8=73728 samples, which corresponds to 1.536 seconds of audio. According to the illustrated example, an additional 3072 samples of audio having no encoding ("no code") are left at the end of the message before a new message is encoded. Accordingly, each message and "no code" corresponds to 73728+3072=76800 samples, which corresponds to 1.6 seconds of audio. Alternatively, any other encoding scheme may be utilized. For example, additional "no code" time may be added such that each message and "no code" corresponds to 2 seconds of audio, each symbol may be encoded in 18432 samples of audio, the audio may be sampled at 96 KHz, and so forth.

In some examples, the encoder 102 is implemented using, for example, a digital signal processor programmed with instructions to encode the information 103. Alternatively, the encoder 102 may be implemented using one or more processors, programmable logic devices, or any suitable combination of hardware, software, and/or firmware. The encoder 102 may utilize any suitable encoding method. Some example methods, systems, and apparatus to encode and/or decode audio watermarks are disclosed in U.S. patent application Ser. No. 12/551,220, entitled "Methods and Apparatus to Perform Audio Watermarking and Watermark Detection and Extraction," filed Aug. 31, 2009, and U.S. patent application Ser. No. 12/464,811, entitled "Methods and Apparatus to Perform Audio Watermarking and Watermark Detection and Extraction," filed May 12, 2009, both of which are hereby incorporated by reference in their entireties.

The example transmitter 106 of FIG. 1 receives an encoded media signal (comprising the encoded audio signal and a video signal 108) and transmits the media signal to the receiver 110. In the illustrated example, the transmitter 106 and the receiver 110 are part of a satellite distribution system. Alternatively, any other type of distribution system may be utilized such as, for example, a wired distribution system, a wireless distribution system, a broadcast system, an on-demand system, a terrestrial distribution system, etc.

Although the distribution system of the example system 100 includes the encoder 102 and a single transmitter 106, the distribution system may include additional elements. For example, the audio signal 104 may be generated at a national network level and distributed to a local network level for local distribution. Accordingly, although the encoder 102 is shown in the transmit lineup prior to the transmitter 106, one or more encoders 102 may be additionally or alternatively provided throughout the distribution system of the audio signal 104 (e.g., at the local network level). Thus, the audio signal 104 may be encoded at multiple levels and may include embedded codes associated with those multiple levels.

After the encoded media signal is received by a receiver 110, the media is presented by the receiver 110 or a device associated with the receiver. According to the illustrated example, the encoded audio signal of the encoded media signal is presented via speaker(s) 114 and/or is output on a line 118. The encoded media signal may be presented using elements such as a display to present video content. The receiver 110 may be any type of media receiver such as a set top box, a satellite receiver, a cable television receiver, a radio, a television, a computing device, a digital video recorder, etc. While the encoded media signal is presented by the receiver 110 of the illustrated example upon receipt, presentation of the encoded media signal may be delayed by, for example, time shifting, space shifting, buffering, etc.

When the encoded media signal is presented to an audience, the decoder receives the encoded audio signal via the line 118 and/or by a microphone 120 that receives the audio output by the speaker(s) 114. The decoder 116 processes the encoded audio signal to extract the information 103 represented by the codes embedded in the encoded audio signal. According to the illustrated example, the decoder 116 samples the encoded audio signal, analyzes the encoded audio signal in the frequency domain to identify frequency components that have been modified (e.g., amplified) by the encoder 102, and determines code symbols corresponding to the modified frequency components. The example decoder 116 transmits extracted information to a central facility for processing (e.g., to generate audience measurement report(s) using information retrieved from multiple monitoring sites). The decoder 116 may be integrated with an audience measurement meter, may be integrated with a receiver 110, may be integrated with another receiver, may be included in a portable metering device, and/or included in a media presentation device, etc. The decoder 116 of the illustrated example determines a most likely symbol at a given instance by analyzing symbols determined for preceding instances as described in conjunction with FIG. 2 below.

The system 100 of the illustrated example may be utilized to identify broadcast media. In such examples, before media is broadcast, the encoder 102 inserts codes indicative of the source of the media, the broadcast time of the media, the distribution channel of the media, and/or any other identifying information. When the media is presented at a monitoring site, the encoded audio of the media is received by a microphone-based platform using free-field detection and processed by the decoder 116 to extract the codes. The codes are then logged and reported to a central facility for further processing and reporting. The microphone-based decoders may be dedicated, stand-alone devices for audience measurement, and/or may be implemented using cellular telephones and/or any other type(s) of devices having microphones and software to perform the decoding and code logging operations. Alternatively, wire-based systems may be used whenever the encoded media may be received via a hard wired connection.

Additionally or alternatively, the system 100 of the illustrated example may be utilized to provide secondary media in association with primary media. In such examples, a primary media presentation device (e.g. a television, a radio, a computing device, and/or any other suitable device) associated with the receiver 110 presents an encoded audio signal as described above. A secondary media presentation device (e.g., a portable media device such as a mobile telephone, a tablet computer, a laptop, etc.) in the vicinity of the presentation receives the encoded audio signal via a microphone. Examples of secondary presentation devices may be, but are not limited to, a desktop computer, a laptop computer, a mobile computing device, a television, a smart phone, a mobile phone, an Apple® iPad®, an Apple® iPhone®, an Apple® iPod®, an Android™ powered computing device, Palm® webOS® computing device, etc. The decoder 116 disposed in the secondary media presentation device then processes the audio signal to extract embedded codes and/or samples of the audio signal are transmitted to a remote location to extract the embedded codes. The codes are then used to select secondary media that is transmitted to the secondary media presentation device for presentation. Accordingly, a secondary media presentation device can obtain secondary content associated with the primary content for presentation on the secondary media presentation device. Example methods, systems, and apparatus to provide secondary media associated with primary media are described in U.S. patent application Ser. No. 12/771,640, entitled "Methods, Apparatus and Articles of Manufacture to Provide Secondary Content in Association with Primary Broadcast Media Content," and filed Apr. 30, 2010, which is hereby incorporated by reference in its entirety.

Figure 2:
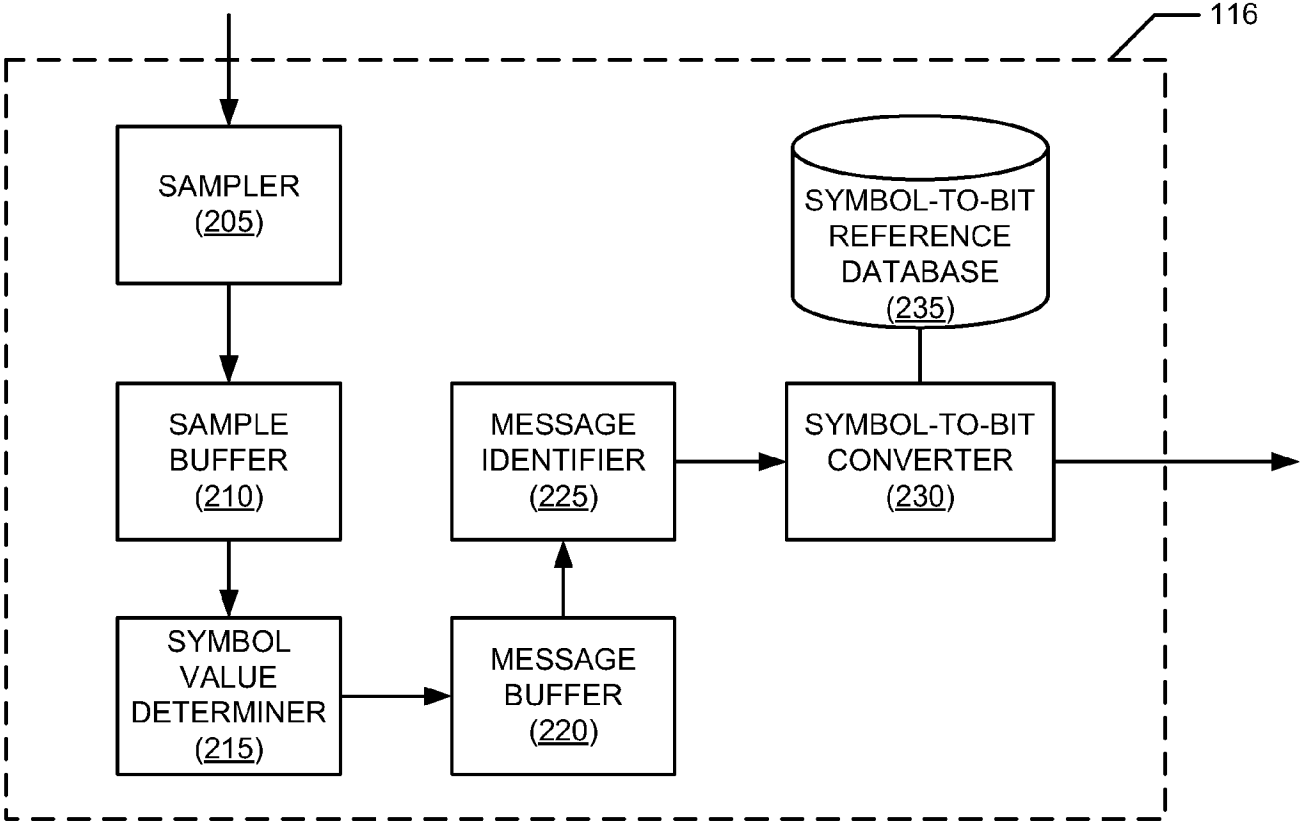
FIG. 2 is a block diagram of the example decoder of the example system of FIG. 1.

FIG. 2 is a block diagram of an example implementation of the example decoder 116. The example decoder 116 of FIG. 2 includes a sampler 205, a sample buffer 210, a symbol value determiner 215, a message buffer 220, a message identifier 225, a symbol-to-bit converter 230, and a symbol-to-bit reference database 235. Prior to decoding, the example decoder 116 receives an audio signal from the microphone 120 of FIG. 1 and/or from live audio.

The example sampler 205 of FIG. 2 converts an analog audio signal into a digitally sampled audio signal. The sampler 205 may be implemented using an analog to digital converter (A/D) or any other suitable technology, to which encoded audio is provided in analog format. The sampler 205 may operate at any appropriate sampling rate for which the decoder is designed. In some examples, the sampler 205 will not sample the received analog audio signal at the same sampling rate utilized by the encoder 102. A lower sampling rate may be used by the sampler 205 to decrease the computational resources needed by the sampler 205. For example, while the example encoder 102 of FIG. 1 samples the audio at 48 kHz, the sampler 205 may sample the audio signal at 16 kHz. In such an example, a "long" block of 9216 samples sampled at 48 kHz comprises 3072 samples when collected at 16 kHz. The example sampler 205 stores the sampled audio signal in the sample buffer 210.

The sample buffer 210 of the illustrated example is implemented by a first in first out circular buffer having a fixed length. Alternatively, the sample buffer 210 may be implemented by any type of buffer or memory and may hold a sampled audio signal of any length (e.g., the sample buffer 210 may store as many samples as memory permits).

The example symbol value determiner 215 of FIG. 2 analyzes a block of samples contained within the sample buffer 210 to determine an encoded symbol value. The symbol value determiner 215 of the illustrated example analyzes the spectral characteristics of the block of samples (e.g., using a sliding Fourier analysis or any other algorithm) to identify frequencies modified (e.g., by the encoder 102 of FIG. 1), determines a symbol represented by the modified frequencies (e.g., using a look-up table that matches the look-up table used by the encoder 102), and analyzes symbols determined from preceding blocks of samples to determine an identified symbol value for the given block. The analysis of preceding blocks of samples is described in further detail in conjunction with FIG. 3. The identified symbol value is stored in the message buffer 220. An example implementation of the symbol value determiner 215 is described in conjunction with FIG. 3.

The example message buffer 220 of FIG. 2 is a circular buffer to store identified symbol values determined by the symbol value determiner 215. The stored values are analyzed by the message identifier to parse the listing of resulting symbol values into messages (e.g., information 103 embedded in the audio signal 104 of FIG. 1). The example message buffer is a first in first out buffer that holds a fixed number of symbols based on the message length. For example, the message buffer 220 of the illustrated example holds a multiple of the number of symbols contained in a message and the number of slides in a spectrum analysis (e.g., the message buffer 220 may be 192×8 where there are 192 slides or sample block shifts and 8 symbols per message). Alternatively, the message buffer 220 may be any type(s) of buffer or memory and may hold any number of symbols (e.g., the message buffer 220 may store as many symbols as memory permits).

The example message identifier 225 of FIG. 2 analyzes the message buffer 220 for a synchronize symbol. When a synchronize symbol is identified, the symbols following the synchronize symbol are output by the message identifier 225. In addition, the sample index identifying the last audio signal sample processed is output. The messages may be subject to validation, comparison for duplicates, etc. For example, an example process for validating messages that may be utilized in conjunction with message identifier 225 is described in U.S. patent application Ser. No. 12/551,220.

The example symbol-to-bit converter 230 receives a message from the message identifier 225 and converts each symbol of the message to the corresponding data bits of information (e.g., the information 103). The data bits may be any machine language, digital transmission, etc. that may be transmitted. The example symbol-to-bit converter 230 utilizes the example symbol-to-bit reference database 235 that stores a look-up table of symbols to corresponding information.

Figure 3:
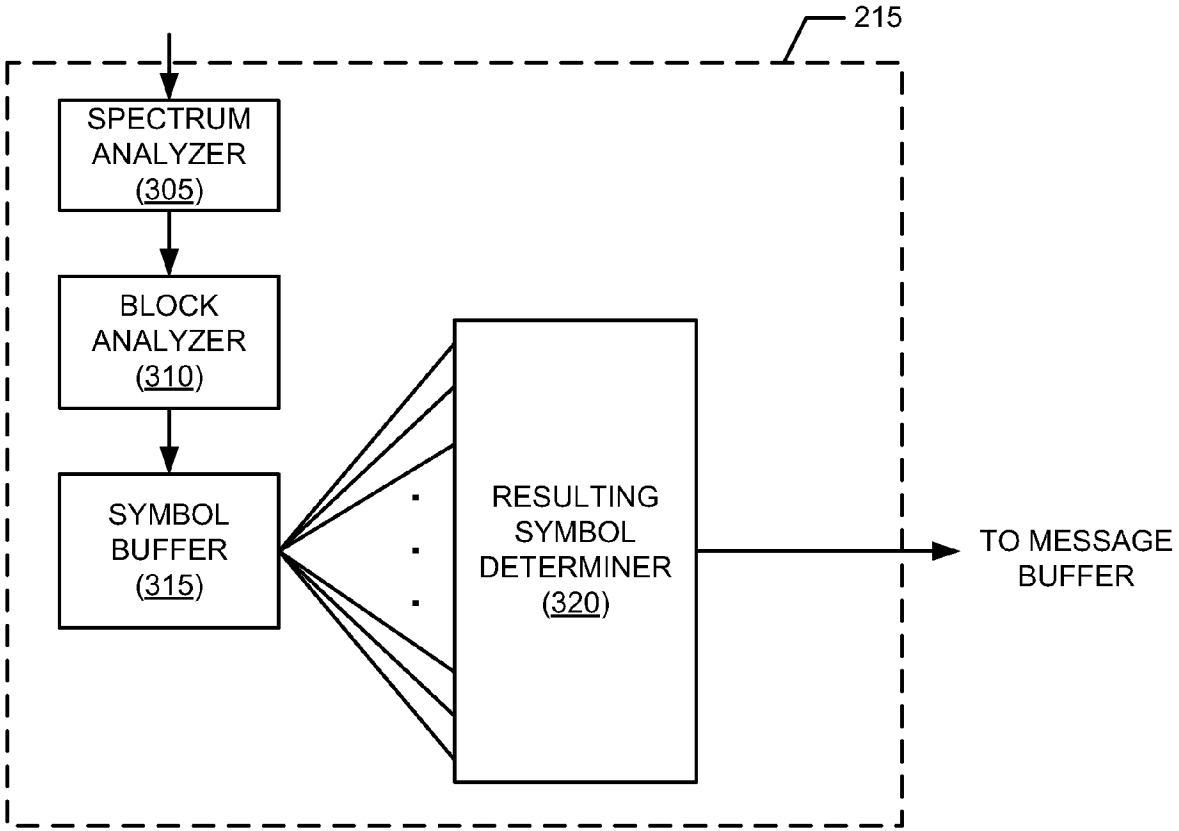
FIG. 3 is a block diagram of the example symbol value determiner of the example decoder of FIG. 2.

A block diagram of an example implementation of the symbol value determiner 215 of FIG. 2 is illustrated in FIG. 3. The example symbol value determiner 215 includes a spectrum analyzer 305, a block analyzer 310, a symbol buffer 315, and a resulting symbol determiner 320.

The spectrum analyzer 305 of the illustrated example performs a time domain to frequency domain conversion of the samples stored in the sample buffer 210. For example, each time a new block of samples is added to the sample buffer 210 (and an oldest block of samples is removed), the spectrum analyzer 305 analyzes the samples in the sample buffer 210 to determine the spectrum of the updated sample buffer. The frequency spectrum results determined by the spectrum analyzer 305 are provided to the block analyzer 310 for determining a symbol value. According to the illustrated example, where the audio signal is sampled at 16 kHz, one symbol is embedded across 3,072 samples. Because the exact boundaries of the symbol are not known, the spectrum analyzer 305 analyzes the incoming audio by sliding through the samples (e.g., analyzing blocks of samples as new samples are slid into a buffer and old samples are slid out of a buffer) to perform a spectrum analyzer each time new samples are received (e.g., 16 samples at a time). Accordingly, it takes 192 slides to move through 3,072 samples resulting in 192 frequency spectrums to be analyzed by the block analyzer 310.

The example block analyzer 310 of FIG. 3 receives the spectrum of frequencies provided by the sliding spectrum analyzer 305 and determines a symbol value for the spectrum of the block of samples. In some examples, the block analyzer 310 processes the results of the spectral analysis to detect the power of predetermined frequency bands and compares the results with a reference database to determine the symbol value based on the spectrum. The block analyzer then reports the determined symbol value to the symbol buffer 315 for storage. An example implementation of the block analyzer 310 is described in greater detail below in FIG. 5.

The symbol buffer 315 stores, in chronological order, the symbol values determined by the block analyzer 310. In some examples the symbol buffer 315 is a first in first out circular buffer. For example, the symbol buffer 315 may store a history of symbols to facilitate comparison of a most recently determined symbol with previously determined symbols. An example implementation of the sample buffer 315 is further detailed in FIG. 6.

The resulting symbol determiner 320 of the illustrated example compares multiple symbol values in the symbol buffer 315 to determine a resulting symbol value. For example, each time a new symbol is added to the symbol buffer 315, the resulting symbol determiner 320 extracts the new symbol, the 9 symbols immediately preceding the new symbol (e.g., the 9 symbols determined during the previous 9 slides of the spectrum analyzer 305), the 10 symbols determined at one message length earlier in the symbol buffer 315, the 10 symbols determined at two message lengths earlier in the symbol buffer 315, and the 10 symbols determined at three message lengths earlier in the symbol buffer 315 as described in further detail in conjunction with FIG. 8. The resulting symbol determiner 320 then identifies the most frequently occurring symbol of the 40 determined symbols as the resulting symbol for the newest added symbol. The resulting symbol is output to the message buffer 220.

Figure 4:
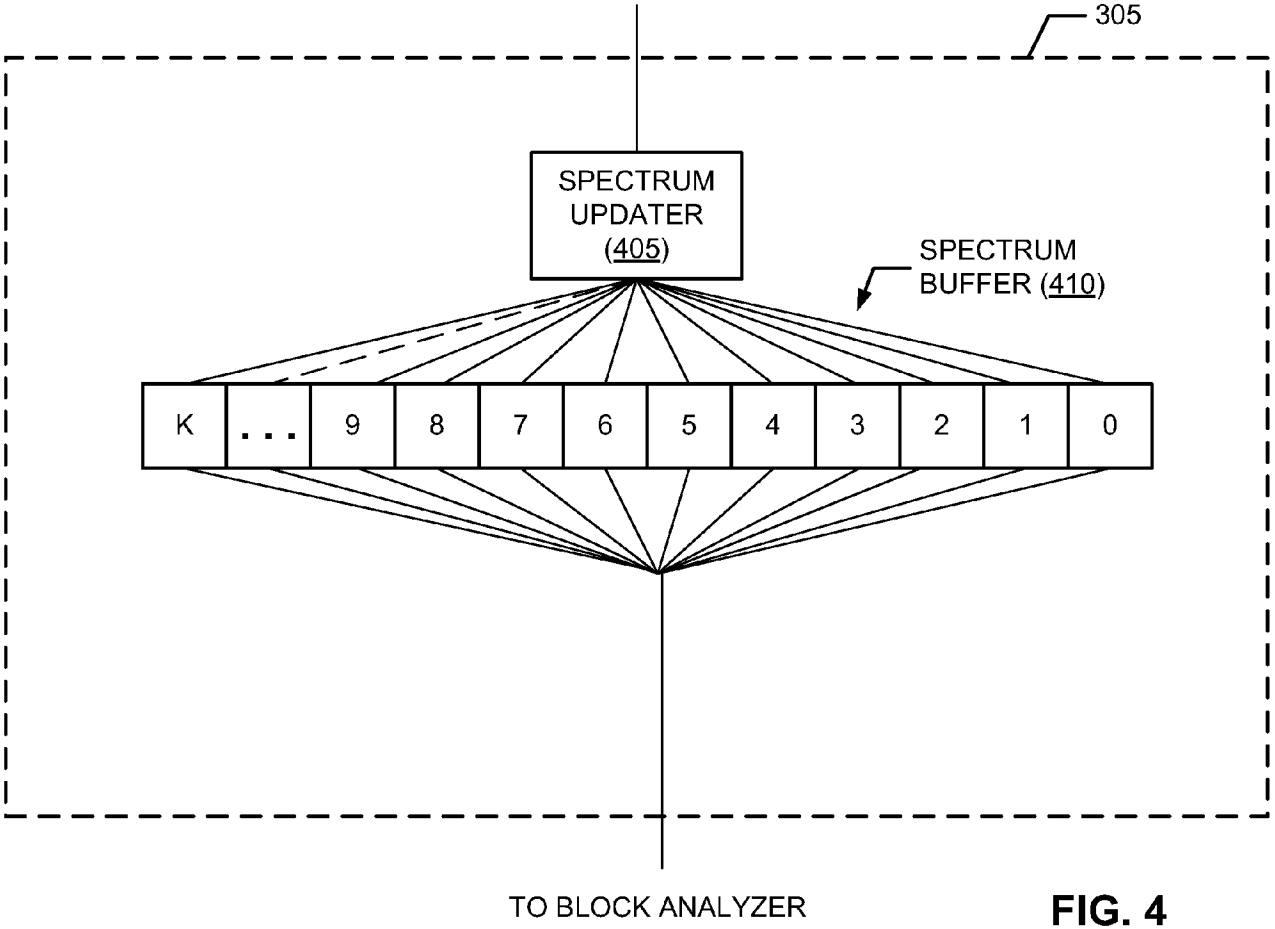
FIG. 4 is a block diagram of the example spectrum analyzer of the example symbol value determiner of FIG. 3.

An example block diagram of the spectrum analyzer 305 of FIG. 3 is illustrated in FIG. 4. The spectrum analyzer 305 of FIG. 4 includes a spectrum updater 405 to update spectrum information in a spectrum buffer following receipt of a set of samples (e.g., 16 incoming samples).

The example spectrum updater 405 of the illustrated example determines spectrum information for the block of samples in the sample buffer 210 based on the previous spectrum information stored in the spectrum buffer 410, information for the samples that are being added to the sample buffer 210, and the samples being removed from the sample buffer 210. For example, the spectrum updater 405 updates spectrum information in the spectrum buffer 410 each time 16 new samples are added to the sample buffer 210 and 16 oldest samples are removed from the sample buffer 210. The example spectrum updater 405 determines amplitude information for frequencies of interest (e.g., frequency indices 1 to K that correspond to any desired frequencies of interest (bins)). Alternatively, the spectrum updater 405 may determine spectrum information for any number of frequencies.

The example spectrum updater 405 determines spectrum information for a frequency of interest k according to the following equation:

$$A_1[k]\exp\varphi_1[k] = A_0[k]e^{\varphi_0[k]}e^{\frac{-i2\pi N_{skip}k}{N}} + \sum_{q=0}^{q=N_{skip}-1}[f_{new}(q) - f_{old}(q)]e^{\frac{i2\pi kq}{N}}e^{\frac{-i2\pi N_{skip}k}{N}}$$

where $A_1[k]$ is the amplitude of frequency k for the new block of samples (after the newest 16 samples are added to the sample buffer 210), $\phi_1[k]$ is the phase of frequency k for the new block of samples, $A_0[k]$ is the amplitude of frequency k for the old block of samples (before the newest 16 samples are added and before the oldest 16 samples are removed from the sample buffer 210), $\phi_0[k]$ is the phase of frequency k for the old block of samples, $N_{skip}$ is the number of new samples added to the sample buffer (e.g., 16 samples), N is the total number of samples in the sample buffer, $f_{new}(q)$ are the samples added to the sample buffer 210, and $f_{old}(q)$ are the old samples removed from the sample buffer 210. Thus, the spectrum is updated by adding information calculated for new samples and removing information for old samples from the prior spectrum information stored in the spectrum buffer 410. This algorithm is computationally efficient by determining spectrum information only for frequencies of interest and by updating spectrum information instead of recalculating a full spectrum each time new samples are added. To add further efficiency, pre-computed sine and cosine tables may be utilized. These pre-computed values may be obtained as the real and imaginary parts of $$e^{\frac{i2\pi k(q-N_{skip})}{N}}$$

for each frequency bin of interest and for $0<=q<N_{skip}$.

According to the illustrated example, value of $f_{old}(q)$ are multiplied by a factor to provide stability. The example factor is $k_2=k_1^N$, where N is the number of slides used to process a block (e.g., N=3072 samples per block/16 samples per slide=192−1=191. The factor $k_1$ may be set to a value close to 1 (e.g., 0.9995) to maintain accuracy. Setting the value to 1 may cause the calculation to be unstable. Thus, according to the illustrated example, $k_2=0.9995^{191}=0.908$. Any other factor(s) may be utilized or the factor may not be included in stability is not an issue.

While an example implementation of the spectrum analyzer 305 is described in conjunction with FIG. 4, any other technique for determining spectrum information (e.g., amplitudes of frequencies of interest), may be utilized by the spectrum analyzer 305. For example, the spectrum analyzer 305 may perform a Fourier transform, a sliding Fourier transform, or any other technique.

Figure 5:
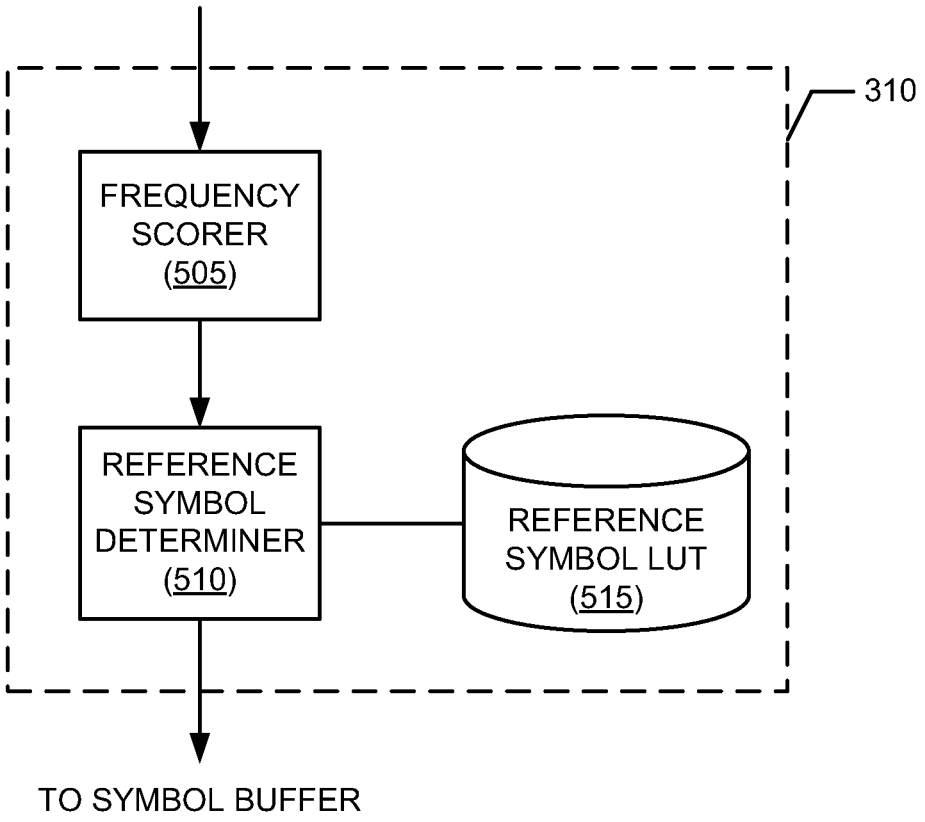
FIG. 5 is a block diagram of the example block analyzer of the example symbol value determiner of FIG. 3.

A block diagram of an example implementation of the block analyzer 310 is illustrated in FIG. 5. The block analyzer 310 of FIG. 5 includes a frequency scorer 505, a reference symbol determiner 510, and a reference symbol LUT 515.

The example frequency scorer 505 receives spectrum information from the spectrum analyzer 305. The frequency scorer 505 determines which frequencies in predefined frequency bands are emphasized in the spectrum analysis. According to the illustrated example, the frequency scorer 505 may assign indices to bins within each frequency band, determine which bin in each band has the largest amplitude, and output the index of the bin as a resulting score for that band. For example, frequency bins may be indexed from 0 to 4607 and may be separated by 5.208 Hz. However, only a subset of the frequency bins may be used for storing encoded information. The example frequency scorer 505 performs this operation on each frequency band in the subset (i.e., the predefined bands) and outputs the indices of the emphasized bins to the reference symbol determiner 510.

The example reference symbol determiner 510 receives indices of the emphasized bins from the frequency scorer 505. According to the illustrated example, the reference symbol determiner 510 compares the indices of the emphasized bins with information stored in the reference symbol LUT 515 to determine a symbol corresponding to the emphasized bins. The reference symbol determiner 510 outputs the resulting symbol to the symbol buffer 315. If no match is found, the reference symbol determiner 510 of the illustrated example outputs an error symbol or provides other notification.

Figure 6:
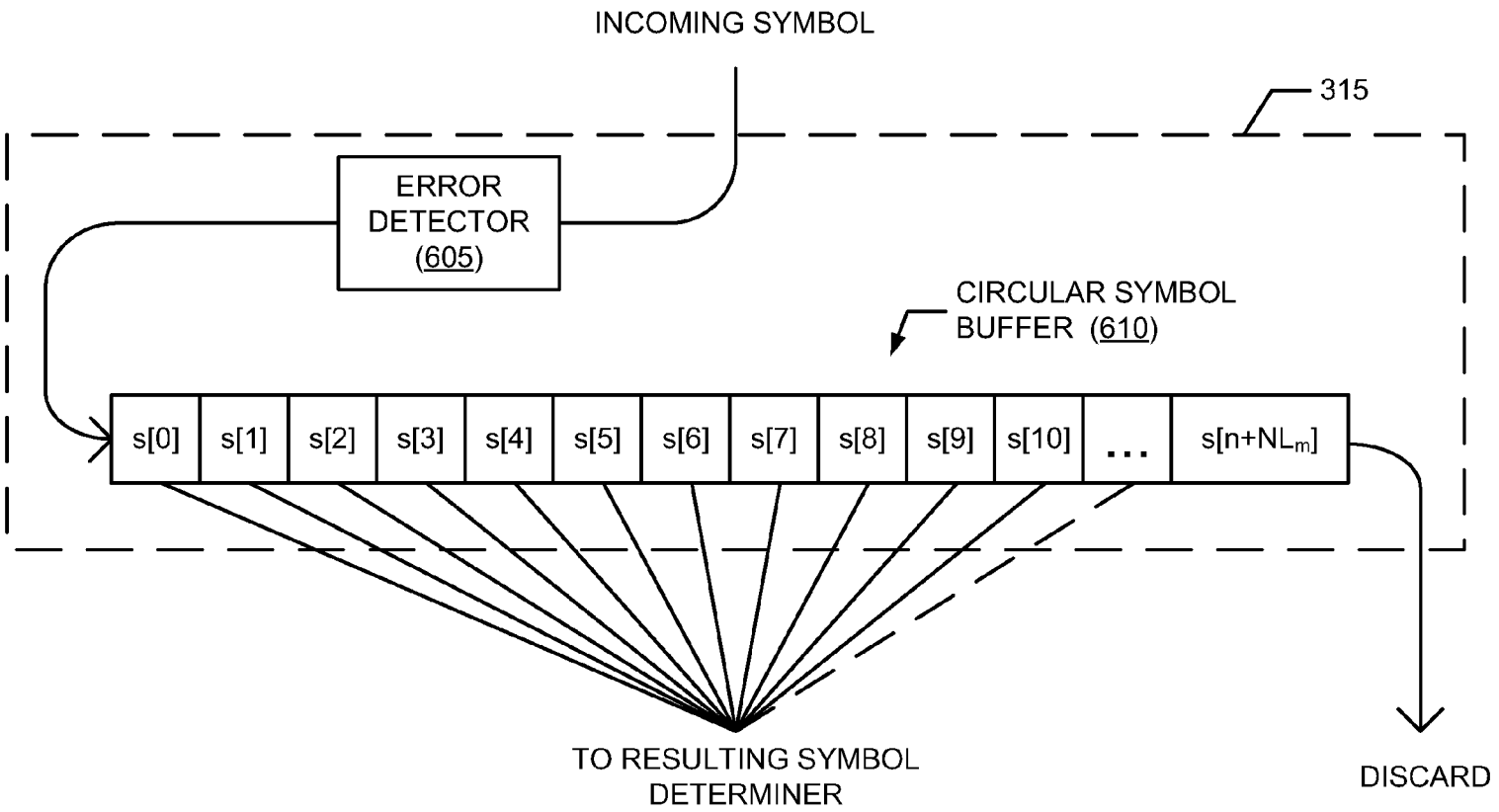
FIG. 6 is a block diagram of the example symbol buffer of the example symbol value determiner of FIG. 3.

FIG. 6 is a block diagram illustrating an example implementation of the symbol buffer 315 of FIG. 3. The example symbol buffer 315 of FIG. 6 includes an example error detector 605 and an example circular symbol buffer 610.

The example error detector 605 of FIG. 6 identifies input that does not conform to the symbol protocol or format that the symbol determiner 215 is programmed to read. In some examples, the error detector 605 may read an error message passed by an earlier element in the analysis (e.g. the reference symbol determiner 510 of FIG. 5, as described above). In some examples, the error detector may generate its own error message because the input symbol is non-conforming data (e.g., based on previous detected symbols, based on detecting a symbol that is not in use, etc.).

The circular symbol buffer 610 of the illustrated example is a circular buffer that is accessed by the resulting symbol determiner 320 of FIG. 3. In the illustrated example, the circular symbol buffer 610 has the following parameters: $L_m$=the number of spectrum analysis slides in one message length and any non-encoded audio following the message within the message interval, $$n=L_m-1$$

N=number of consecutive messages stored by the circular symbol buffer 610, $$s=\{0,\ldots,n+NL_m\}, \text{ where}$$

s[0]=most recently stored symbol value and
s[n+N$L_m$]=oldest stored symbol value.

For example, in the example disclosed herein the sampled audio signal is sampled at a rate of 16 kHz, a long-block of samples is 3072 samples, and a message comprises eight symbols encoded in eight long blocks followed by 12 non-encoded blocks at 48 KHz (4 blocks of 256 samples at 16 KHz). In such an example, $L_m$=3072 samples per symbol×8 symbols/16 samples per slide+4 blocks×256 samples/16 samples per slide=1600 sets.

In another example, the eight symbols may be followed by a period of non-encoded audio to further separate messages. For example, 24,576 samples of encoded audio (e.g., 3072×8) may be followed by 7424 samples of non-encoded audio so that each message corresponds to 32,000 samples or 2 seconds. In such an example, $L_m$=3072 samples per symbol×8 symbols/16 samples per slide+7424 samples/16 samples per slide=2000 sets.

Figure 7:
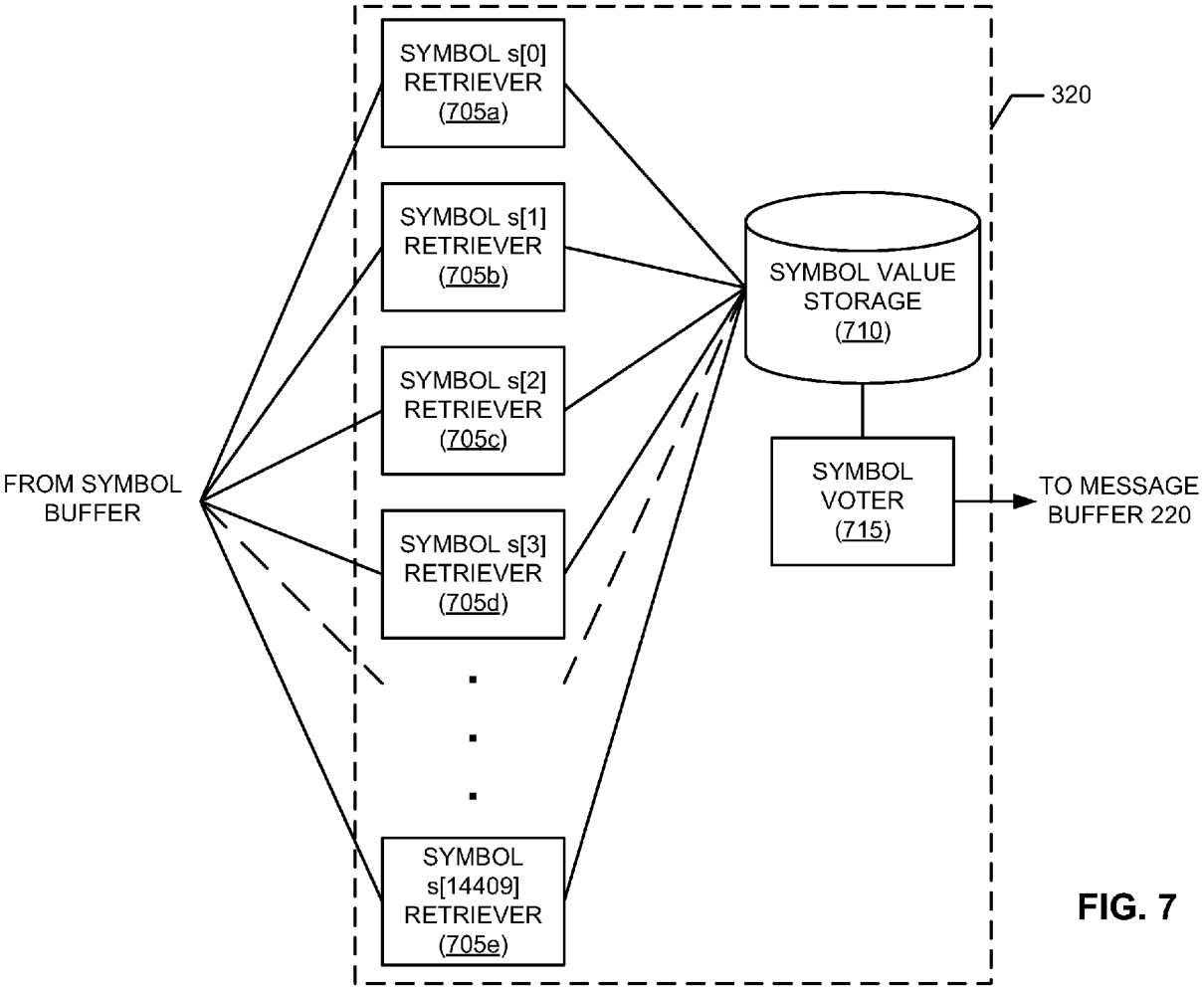
FIG. 7 is a block diagram of the resulting symbol determiner of the example symbol value determiner of FIG. 3.

An example implementation of the resulting symbol determiner 320 of FIG. 3 is illustrated in FIG. 7. The example resulting symbol determiner 320 of FIG. 7 includes a series of example symbol retrievers 705, a symbol value storage 710, and a symbol voter 715. Although a plurality of symbol retrievers 705 are included in the illustrated example, the resulting symbol determiner 320 may alternatively include fewer or one symbol retriever 705 that retrieve(s) multiple symbols.

The series of symbol retrievers 705 of the illustrated example retrieve a collection of symbols for analysis. For example, according to the illustrated example, the series of symbol retrievers 705 retrieve the most recently received 10 symbols: s[0]-s[9], the 10 symbols that are one message length prior to the most recently received 10 symbols: s[0+$L_m$]-s[9+$L_m$], the 10 symbols that are two message lengths prior to the most recently received 10 symbols: s[0+2$L_m$]-s[9+2$L_m$], and the 10 symbols that are three message lengths prior to the most recently received 10 symbols: s[0+3$L_m$]-s[9+3$L_m$. Such a retrieval approach takes advantage of the understanding that the 10 consecutive symbols (e.g., symbols determined for 10 partially overlapping sets corresponding to slides by 16 samples each) are likely to include the same embedded code. In addition, the retrieval approach takes advantage of the understanding that symbols that are one message length away are likely to be the same where most or all of the symbols of a message are repeatedly encoded in an audio signal. In other implementations, different groups of symbols may be analyzed. For example, if it is determined that the same message is encoded every 5 messages, then the symbols spaced 5 message lengths apart should be compared. Additionally, more of fewer consecutive symbols may be retrieved. For example, more consecutive symbols may be selected if the number of samples in each slide of the spectral analysis is decreased, if the number of samples corresponding to a symbol encoding is increased, and/or if the sampling rate is decreased.

According to the example of FIG. 7:

$$s[0]=\text{first symbol value}$$

o=one less than the number of consecutive overlapping blocks separated by one slide or shift. M represents the set of locations at prior messages to be analyzed, which are the points in the symbol buffer to extract symbol values for message-region analysis. For example, a sample set for M is provided below to illustrate the formation of the series s for analyzing the current message and the three preceding messages:

$$M=\{0,1,2,3\}$$

$$s=\{\{0,1,\ldots,o\},\{0+L_m,1+L_m,\ldots,o+L_m\},\{0+2L_m,1+2L_m,\ldots,o+2L_m\},\{0+L_m,1+3L_m,\ldots,o+3L_m\}\}$$

The series of symbol retrievers 705 retrieve corresponding symbol(s) of the listed series and store the values in the symbol value storage 710.

Returning to the example signal sampled at 16 kHz in which each slide comprises 16 samples and the resulting symbol determiner 320 analyzes ten consecutive sets of samples overlapping by one slide (i.e., overlapping by 16 samples), wherein s[0] is the first block, thus:

$$o=9(\text{10 sets of samples minus 1})$$

In example implementations, the example resulting symbol determiner 320 evaluates ten overlapping blocks at message regions three, six, and nine message lengths prior to the first symbol value. For example, messages may be spaced sufficiently far apart (e.g., 3 messages/4.8 seconds apart or any other separation) to enable additional messages to be inserted by other parties or at other levels of the media distribution chain. Thus:

$$M=\{0,3,6,9\}$$

and:

$$L_m=1600 \text{ slides/sets}\times 3 \text{ for message separation}=4800$$

and, thus:

$$s=\{0,1,2,3,4,5,6,7,8,9,4800,4801,4802,4803,4804,4805,4806,4807,4808,4809,9600,9601,9602,9603,9604,9605,9606,9607,9608,9609,14400,14401,14402,14403,14404,14405,14406,14407,14408,14409\}$$

In such an example, the resulting symbol determiner 320 will have a series of 40 symbol retrievers 705 to retrieve the symbol values in the symbol buffer 315 corresponding to the values of s listed above. The example symbol buffer 315 may store 4 messages across 4800 samples (including the separation), which is 4×4800=19200 total symbols. The series of 40 symbol retrievers 705 then store the retrieved symbol values (e.g., a 7-bit number) into the symbol value storage 710.

The symbol value storage 710 of the illustrated example may be implemented by any appropriate temporary or permanent storage which may receive input from the series of symbol retrievers 705 and be accessed by the symbol voter 715.

The symbol voter 715 of the illustrated example analyzes the symbol values stored in the symbol value storage 710 and determines a resulting symbol value from the symbol values stored in the symbol value storage 710. According to the illustrated example, the symbol voter 715 determines the most occurring symbol of the symbols stored within the symbol value storage 710 using voting. In some examples, the symbol voter may assign different voting "weight" to different symbol values. For example, the symbol voter 715 may assign greater weight to symbols extracted from long blocks overlapping the first extracted symbol value (e.g., s[0]-s[9]), may assign decreasing weight as the symbol index increases (e.g., as symbols represent earlier times), may assign weights based on a confidence score for the symbol determination, etc.

Figure 8:
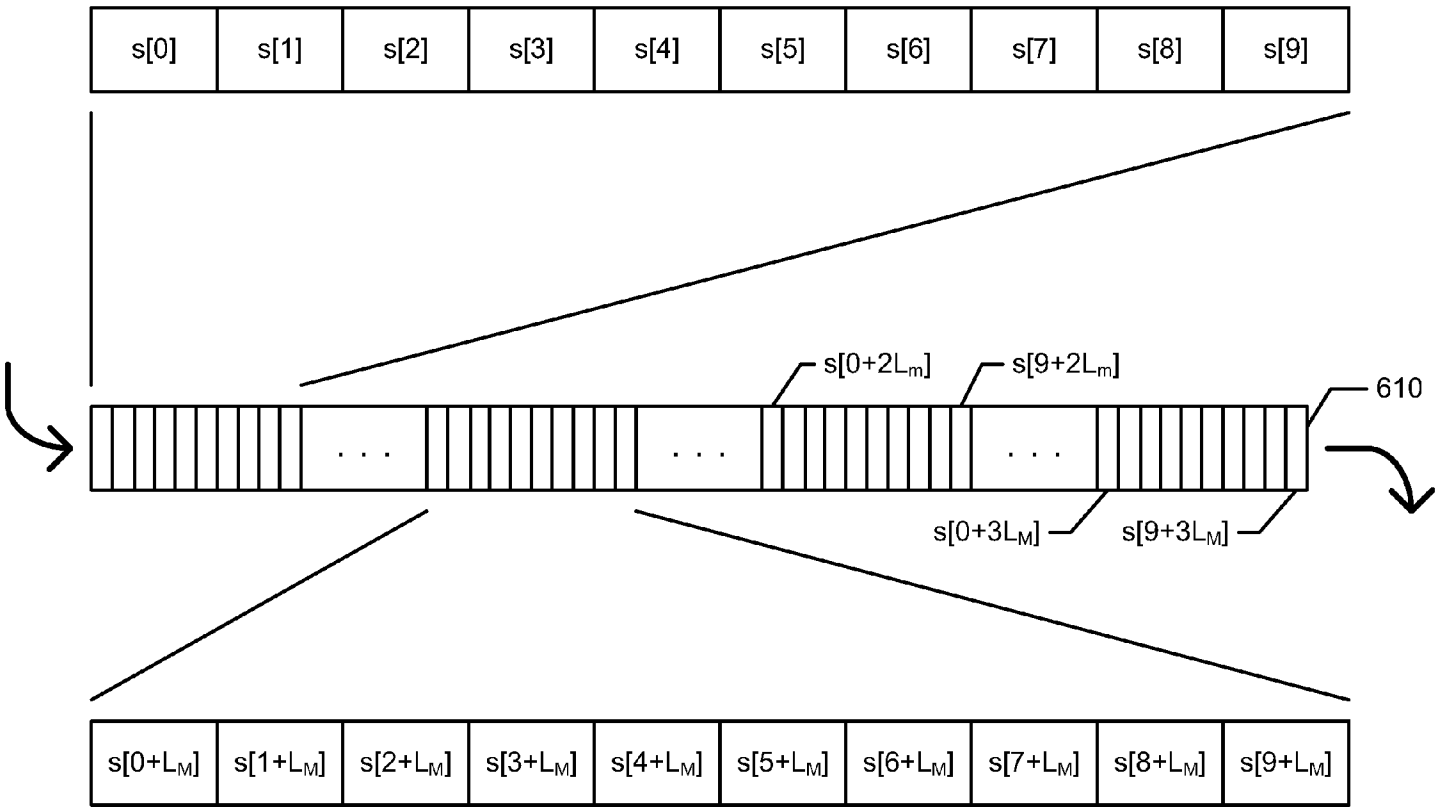
FIG. 8 illustrates example contents of the example symbol buffer of FIG. 3.

FIG. 8 illustrates an example implementation of the circular symbol buffer 610 in which a pre-determined set of symbol values is stored in the buffer. The circular symbol buffer 610 of FIG. 8 stores a symbol value for a series of long blocks of samples in which each long block of samples overlaps the prior long block of samples. In the present example:

$L_m$=a constant representing the length in samples of one message plus any non-encoded audio following the message within the message interval $M=\{0,1,2,3\}$ $s[0, \ldots, 9+3L_m]$=a series of symbol values stored in the buffer.

Recall that M represents the series of message-regions to be analyzed to determine a symbol value. In this example, the message-regions located one, two, and three message lengths ($L_m$) prior to s[0] are selected. In this example, the symbol values to be analyzed are shown at each message-region.

Figure 9:
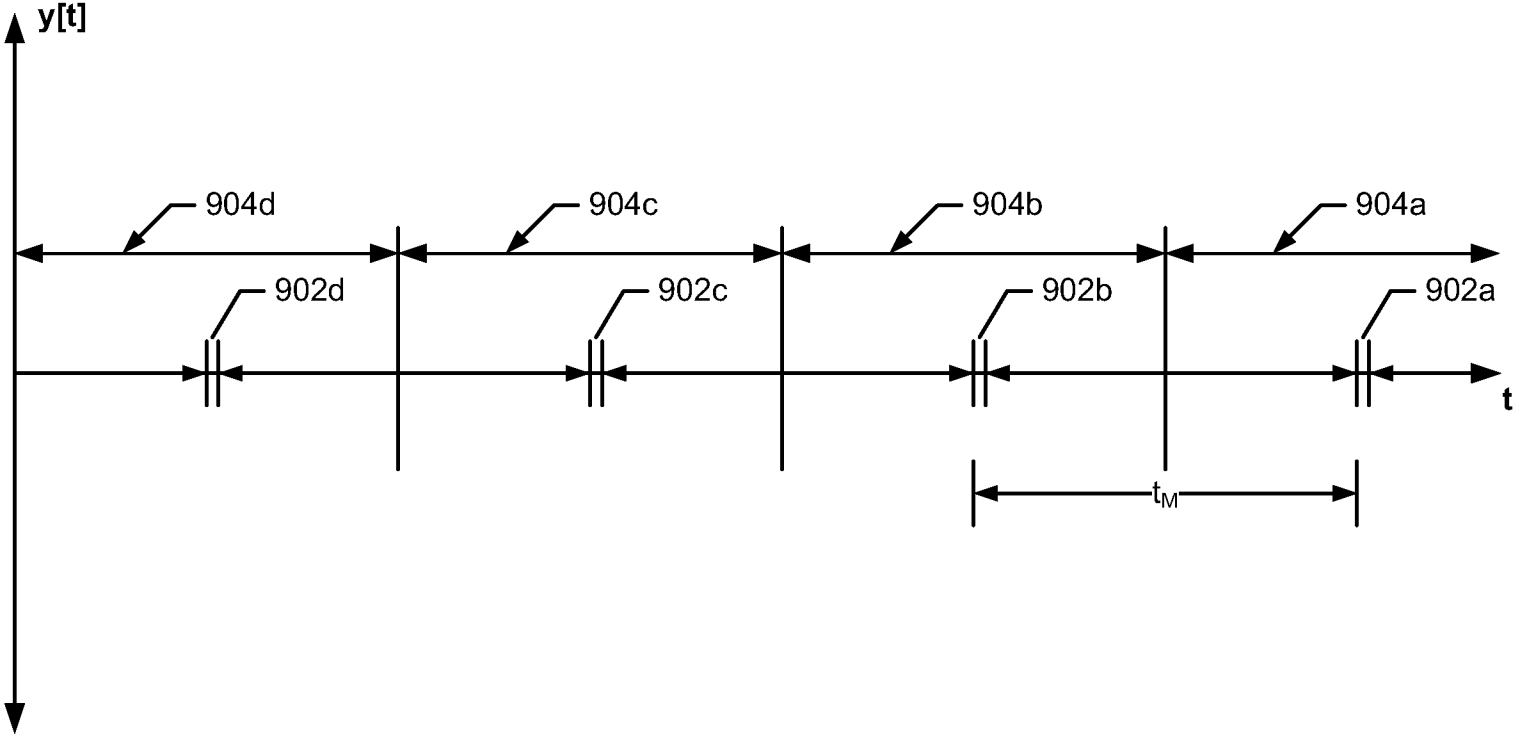
FIG. 9 illustrates example message-regions from which an example symbol value determiner may select blocks of samples to determine symbol values.

FIG. 9 is an illustration, in the time domain, of example message-regions from which symbol values of FIG. 8 are extracted from long blocks of samples targeted for analysis. In the interest of clarity, the waveform of the discrete time audio signal y[t] is omitted from the illustration. Each period of time 904*a-d* illustrates the period of time $t_M$ needed to embed a message in an audio signal.

The message-regions 902*a-d* illustrate the portions of the audio signal from which the symbol values of FIG. 8 used to determine a resulting symbol value originate. For example, message-region 902*a* corresponds to the region beginning at s[0] and containing the series s[0, 1, 2, . . . 9]. Likewise, 902*b*, 902*c*, and 902*d* correspond to s[0+$L_M$], s[0+2$L_M$], and s[0+3$L_M$] respectively.

Figure 10:
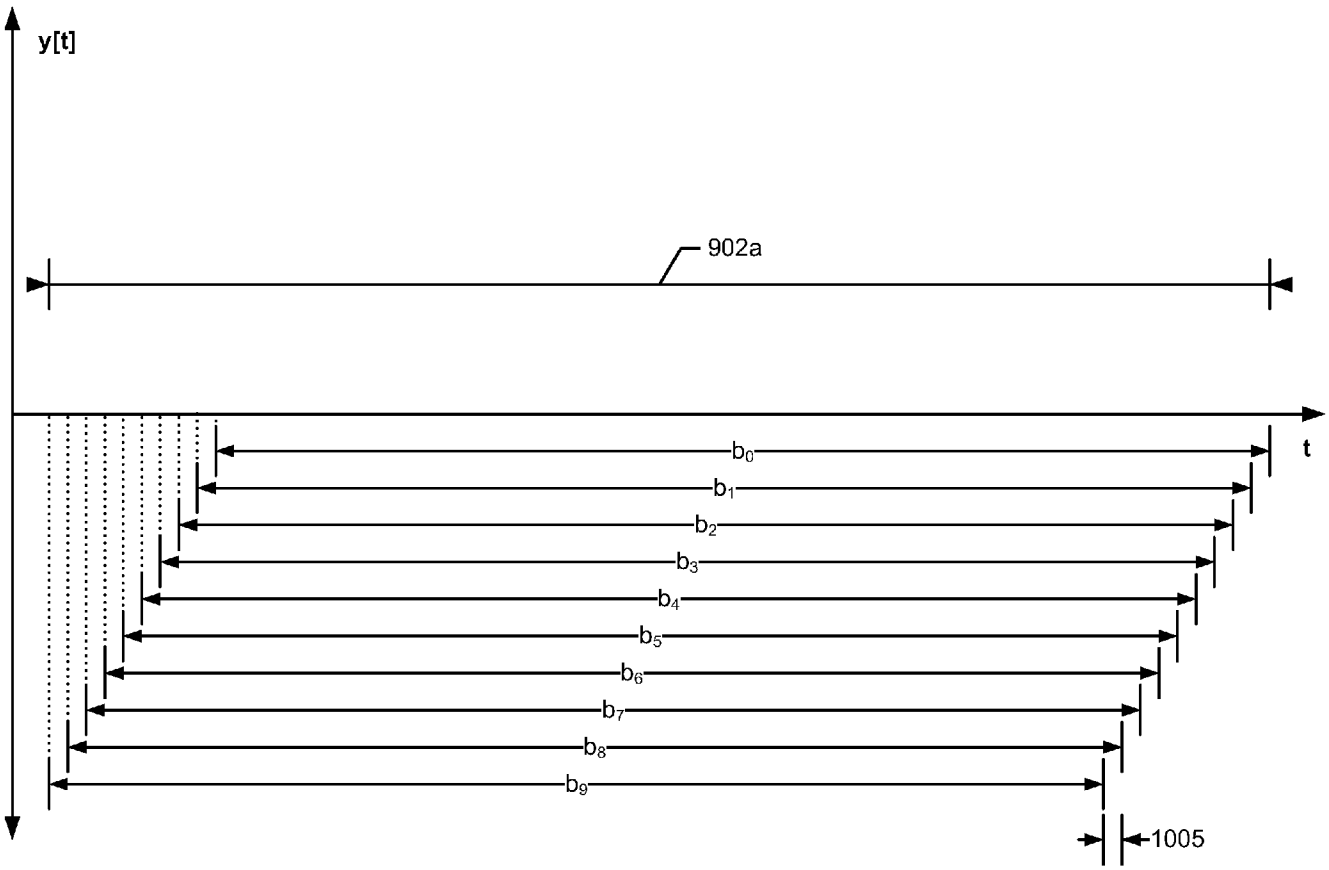
FIG. 10 is a magnified view of one of the example message-regions of FIG. 9.

FIG. 10 is a magnified illustration, in the time domain, of the example message-region 902*a*. As in FIG. 9, in the interest of clarity, the waveform of the discrete time audio signal y[t] is omitted from the illustration. The message region 902*a* includes 10 overlapping long blocks of samples ($b_0$-$b_9$). Each long block overlaps the previous long block by the gap 1005. Gap 1005 is the same amount of samples as a slide of samples used by the spectrum analyzer 305. In other words, block b0 overlaps the preceding block b1 by all but the newest samples retrieved and the oldest samples removed.

While an example manner of implementing the example decoder 116 of FIG. 1 has been illustrated in FIG. 2, an example manner of implementing the symbol value determiner 215 of FIG. 2 has been illustrated in FIG. 3, example manners of implementing the spectrum analyzer 305, the block analyzer 310, the symbol buffer 315, and the resulting symbol determiner 320 have been illustrated in FIGS. 3-6, and an example manner of implementing the resulting symbol value determiner has been illustrated in FIG. 7, one or more of the elements, processes and/or devices illustrated in FIGS. 1-7 may be combined, divided, re-arranged, omitted, eliminated and/or implemented in any other way. Further, the example decoder 116, the example sampler 205, the example sample buffer 210, the example symbol value determiner 215, the example message buffer 220, the example message identifier 225, the example symbol-to-bit converter 230, the example spectrum analyzer 305, the example block analyzer 310, the example symbol buffer 315, the example resulting symbol determiner 320, the example spectrum updater 405, the example slide spectrum buffer 410, the example frequency scorer 505, the example reference symbol determiner 510, the example error detector 605, the example circular symbol buffer 610, the example symbol retrievers 705, and the example symbol voter 715 of FIGS. 1-7 may be implemented by hardware, software, firmware and/or any combination of hardware, software and/or firmware. Thus, the example sampler 205, the example sample buffer 210, the example symbol value determiner 215, the example message buffer 220, the example message identifier 225, the example symbol-to-bit converter 230, the example spectrum analyzer 305, the example block analyzer 310, the example symbol buffer 315, the example resulting symbol determiner 320, the example spectrum updater 405, the example slide spectrum buffer 410, the example frequency scorer 505, the example reference symbol determiner 510, the example error detector 605, the example circular symbol buffer 610, the example symbol retrievers 705, and/or the example symbol voter 715 and/or, more generally, the decoder 116 of FIGS. 1-7 or any other block of FIGS. 1-7 could be implemented by one or more circuit(s), programmable processor(s), application specific integrated circuit(s) (ASIC(s)), programmable logic device(s) (PLD(s)) and/or field programmable logic device(s) (FPLD(s)), etc. When any of the apparatus or system claims of this patent are read to cover a purely software and/or firmware implementation, at least one of the example sampler 205, the example sample buffer 210, the example symbol value determiner 215, the example message buffer 220, the example message identifier 225, the example symbol-to-bit converter 230, the example spectrum analyzer 305, the example block analyzer 310, the example symbol buffer 315, the example resulting symbol determiner 320, the example spectrum updater 405, the example slide spectrum buffer 410, the example frequency scorer 505, the example reference symbol determiner 510, the example error detector 605, the example circular symbol buffer 610, the example symbol retrievers 705, and/or the example symbol voter 715 and/or, more generally, the decoder 116 of FIGS. 1-7 are hereby expressly defined to include a tangible computer readable medium such as a memory, DVD, CD, Blu-ray, etc. storing the software and/or firmware. Further still, the example sampler 205, the example sample buffer 210, the example symbol value determiner 215, the example message buffer 220, the example message identifier 225, the example symbol-to-bit converter 230, the example spectrum analyzer 305, the example block analyzer 310, the example symbol buffer 315, the example resulting symbol determiner 320, the example spectrum updater 405, the example slide spectrum buffer 410, the example frequency scorer 505, the example reference symbol determiner 510, the example error detector 605, the example circular symbol buffer 610, the example symbol retrievers 705, and/or the example symbol voter 715 and/or, more generally, the decoder 116 of FIGS. 1-7 may include one or more elements, processes and/or devices in addition to, or instead of, those illustrated in FIGS. 1-7, and/or may include more than one of any or all of the illustrated elements, processes and devices.

Flowcharts representative of example machine readable instructions for implementing the example decoder 116, the example symbol determiner 215, the example spectrum analyzer 305, the example block analyzer 310, the example symbol buffer 315, the example resulting symbol determiner 320, and the example message identifier 225 are shown in FIGS. 11-16. In these examples, the machine readable instructions comprise program(s) for execution by a processor such as the processor 1712 shown in the example processing platform 1700 discussed below in connection with FIG. 17. The program may be embodied in software stored on a tangible computer readable medium such as a CD-ROM, a floppy disk, a hard drive, a digital versatile disk (DVD), a Blu-ray disk, or a memory associated with the processor 1712, but the entire program and/or parts thereof could alternatively be executed by a device other than the processor 1712 and/or embodied in firmware or dedicated hardware. Further, although the example programs are described with reference to the flowcharts illustrated in FIGS. 11-16, many other methods of implementing, the example decoder 116, the example symbol determiner 215, the example spectrum analyzer 305, the example block analyzer 310, the example symbol buffer 315, the example resulting symbol determiner 320, and the example message identifier 225 may alternatively be used. For example, the order of execution of the blocks may be changed, and/or some of the blocks described may be changed, eliminated, or combined.

As mentioned above, the example processes of FIGS. 11-16 may be implemented using coded instructions (e.g., computer readable instructions) stored on a tangible computer readable medium such as a hard disk drive, a flash memory, a read-only memory (ROM), a compact disk (CD), a digital versatile disk (DVD), a cache, a random-access memory (RAM) and/or any other storage media in which information is stored for any duration (e.g., for extended time periods, permanently, brief instances, for temporarily buffering, and/or for caching of the information). As used herein, the term tangible computer readable medium is expressly defined to include any type of computer readable storage device and/or storage disc, and to exclude propagating signals. Additionally or alternatively, the example processes of FIGS. 11-16 may be implemented using coded instructions (e.g., computer readable instructions) stored on a non-transitory computer readable medium such as a hard disk drive, a flash memory, a read-only memory, a compact disk, a digital versatile disk, a cache, a random-access memory and/or any other storage media in which information is stored for any duration (e.g., for extended time periods, permanently, brief instances, for temporarily buffering, and/or for caching of the information). As used herein, the term non-transitory computer readable medium is expressly defined to include any type of computer readable device and/or storage disk, and to exclude propagating signals. As used herein, when the phrase "at least" is used as the transition term in a preamble of a claim, it is open-ended in the same manner as the term "comprising" is open ended. Thus, a claim using "at least" as the transition term in its preamble may include elements in addition to those expressly recited in the claim.

Figure 11:
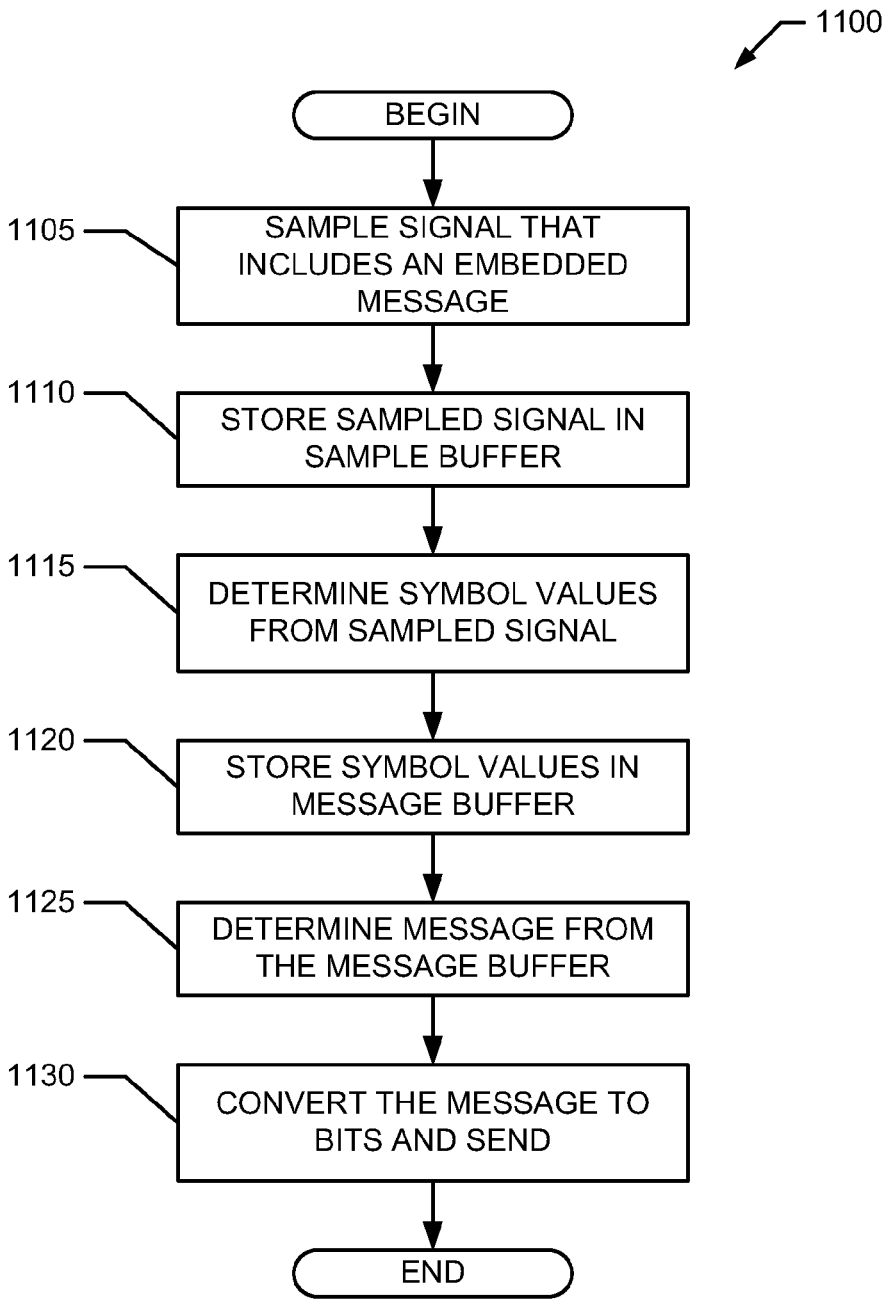
FIG. 11 is a flowchart representative of example machine readable instructions that may be executed to implement the example decoder of FIGS. 1 and/or 2.

FIG. 11 is a flowchart of example machine readable instructions 1100 that may be executed to implement the decoder 116 of FIGS. 1 and/or 2. With reference to FIGS. 1 and/or 2, the example machine readable instructions 1100 of FIG. 11 begin execution when the sampler 205 samples the audio portion of a media signal including an embedded message (block 1105). The sampled audio signal is stored in the sample buffer 210 (block 1110). The symbol value determiner 215 determines symbol values from the sampled signal (block 1115). The symbol values determined by the symbol value determiner 215 are stored within the message buffer 220 (block 1120). A message is determined by the message identifier 225 from the values stored within the message buffer 220 (block 1125). The message is converted to bits by the symbol-to-bit converter 230 using the symbol-to-bit reference database 235 (block 1130).

Figure 12:
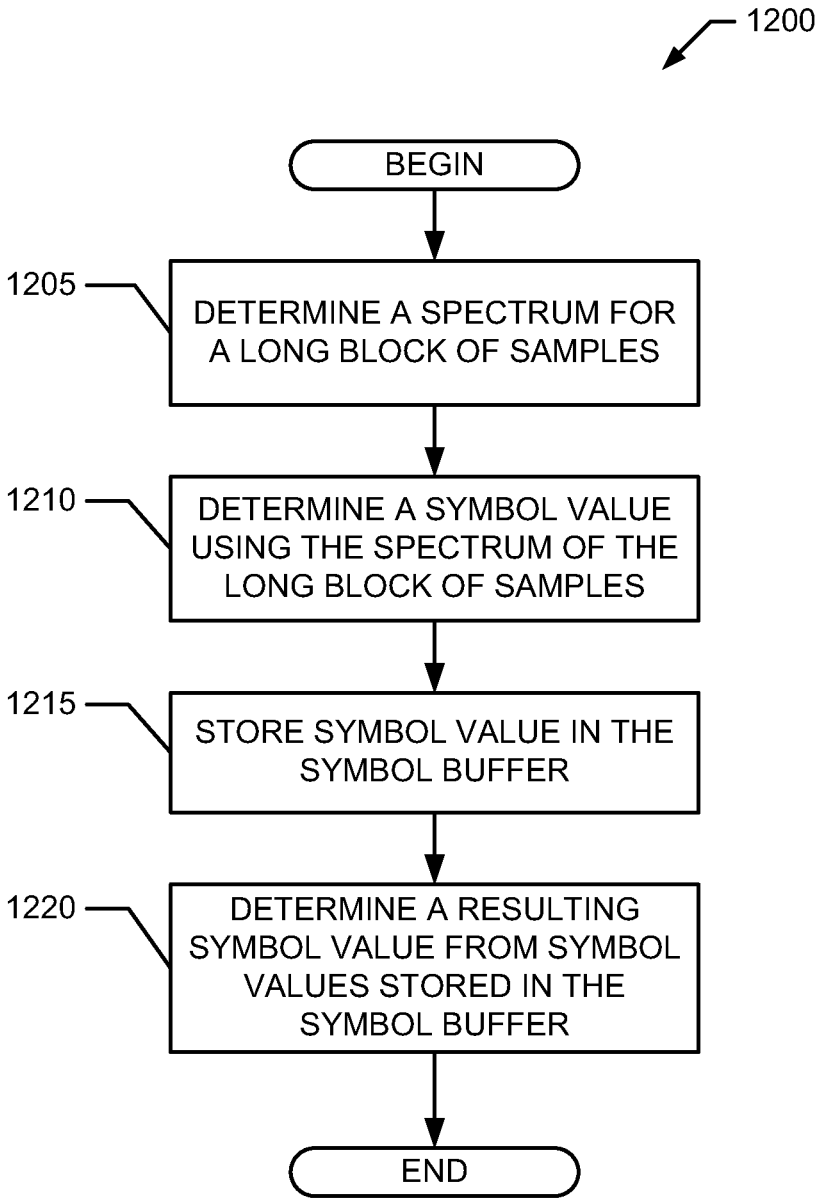
FIG. 12 is a flowchart representative of example machine readable instructions that may be executed to implement the example symbol value determiner of FIGS. 2 and/or 3.

FIG. 12 is a flowchart of example machine readable instructions 1200 that may be executed to implement the symbol value determiner 215 of FIGS. 2 and/or 3 and to implement block 1115 of the flowchart of FIG. 11. With reference to FIGS. 2 and/or 3, the example machine readable instructions 1200 of FIG. 12 begin when the spectrum analyzer 305 determines a spectrum for a long block of samples stored in the sample buffer 210 (block 1205). The block analyzer 310 determines a symbol value using the spectrum of the long block of samples (block 1210). The determined symbol value is then stored in the symbol buffer (block 1215). Blocks 1205, 1210, and 1215 may be repeated to fill the symbol buffer 315. The resulting symbol determiner 320 then determines a resulting symbol value from symbol values stored in the symbol buffer (block 1220).

Figure 13:
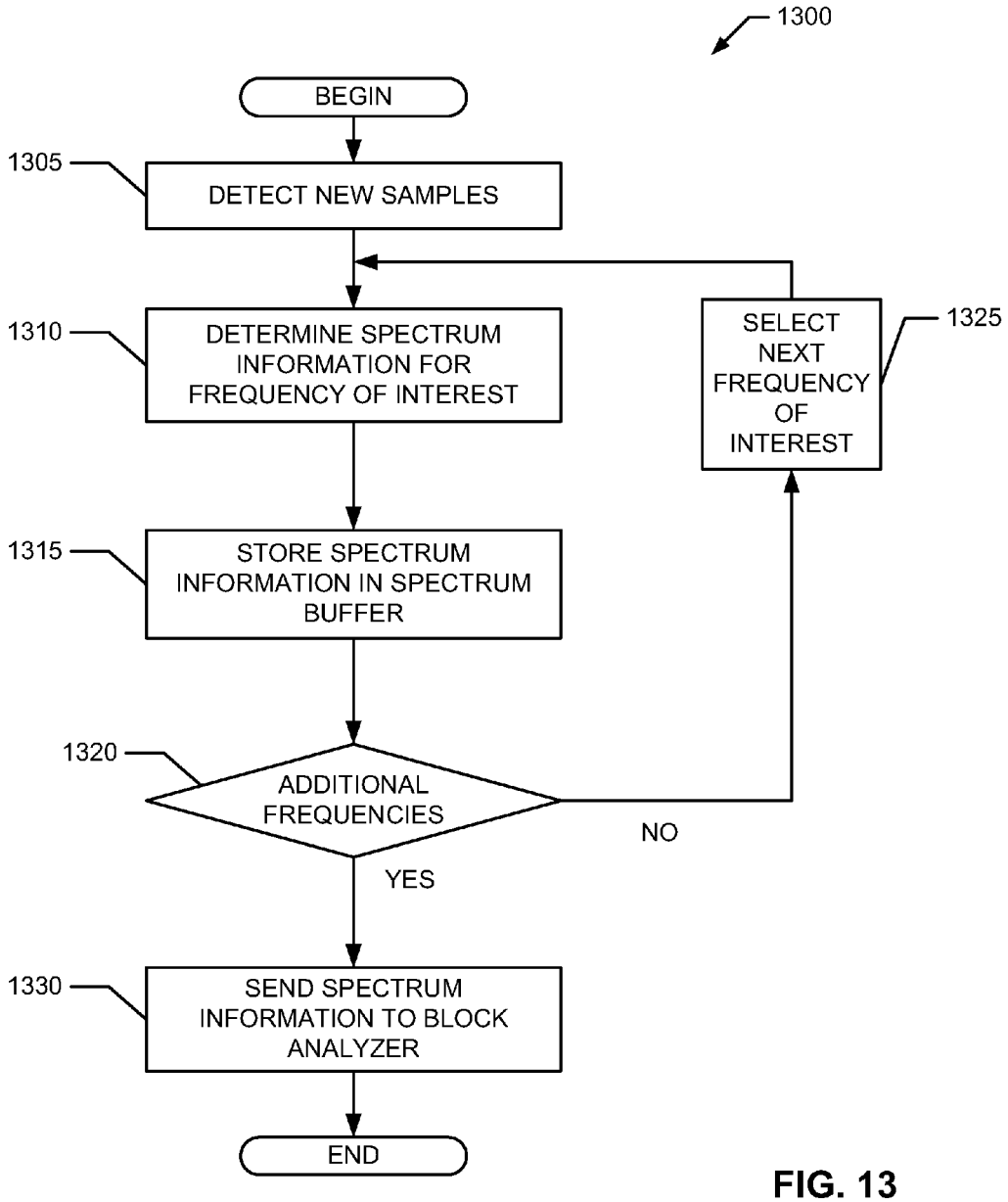
FIG. 13 is a flowchart representative of example machine readable instructions that may be executed to implement the example spectrum analyzer of FIGS. 3 and/or 4.

FIG. 13 is a flowchart of example machine readable instructions 1300 that may be executed to implement the spectrum analyzer 305 of FIGS. 3 and/or 4 and to implement block 1205 of FIG. 12. With reference to FIGS. 3 and 4, the example machine readable instructions begin execution at block 1305 at which the spectrum updater 405 detects and receives a newly gathered set of samples (e.g., following the additional of 16 new samples to the sample buffer 210) (block 1305). The spectrum updater 405 updates spectrum information for a particular frequency (e.g., a first frequency of interest or bin) in view of the newly added samples and samples removed from the sample buffer 210 (e.g., using the technique described in conjunction with FIG. 4) (block 1310). The spectrum updater 405 stores the updated frequency information (e.g., amplitude information for the frequency of interest) in the spectrum buffer 410 (block 1315). The spectrum updater 405 determines if there are additional frequencies to be analyzed (block 1320). When there are additional frequencies to be analyzed, the spectrum updater 405 selects the next frequency and control returns to block 1310 to determine spectrum information for the next frequency (block 1325).

When there are no additional frequencies to be analyzed (block 1320), the spectrum updater 405 sends the spectrum information in the spectrum buffer 410 to the block analyzer 310 (block 1330).

Figure 14:
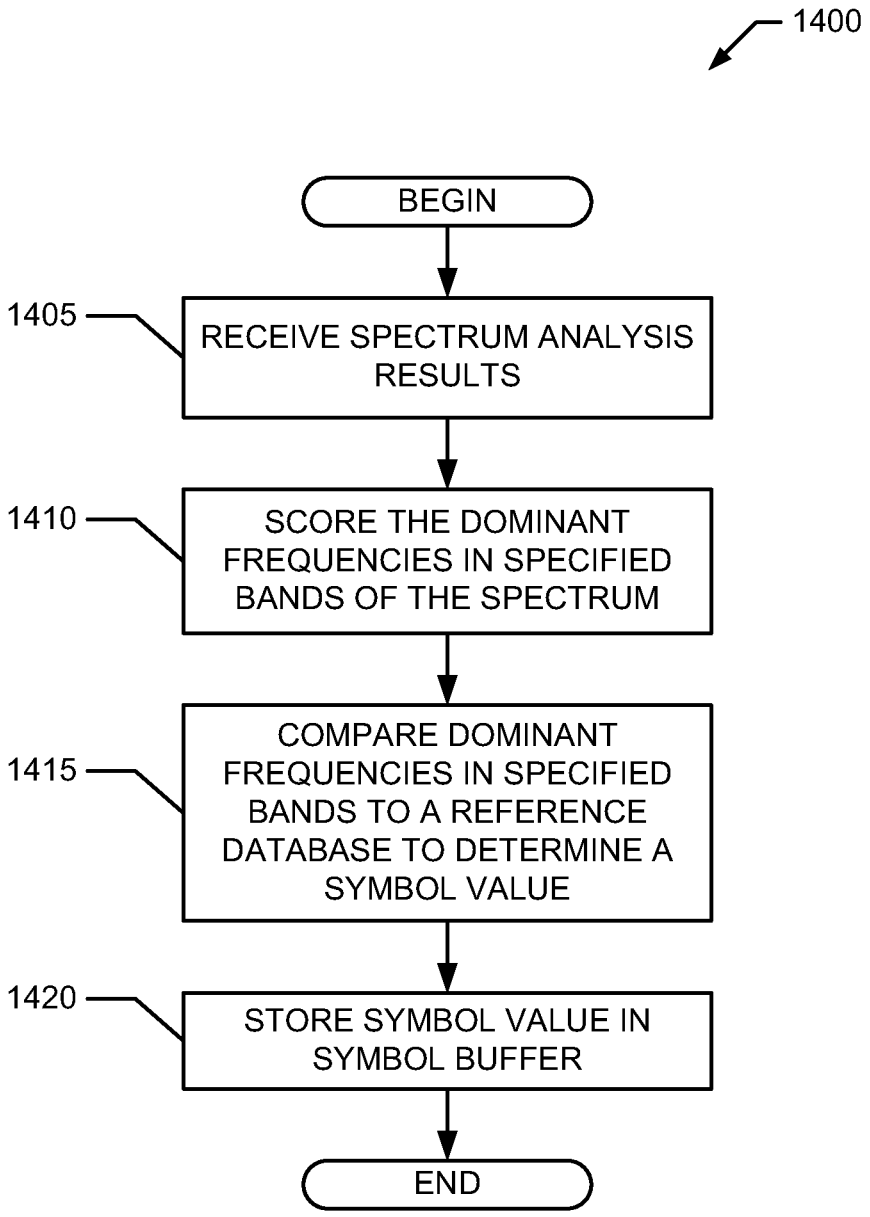
FIG. 14 is a flowchart representative of example machine readable instructions that may be executed to implement the example block analyzer of FIGS. 3 and/or 5.

FIG. 14 is a flowchart of example machine readable instructions 1400 that may be executed to implement the block analyzer 310 of FIGS. 3 and/or 5 and to implement block 1210 of FIG. 12. With reference to FIGS. 3 and/or 5, the example machine readable instructions 1400 of FIG. 14 begin when the frequency scorer 505 receives spectrum analysis results from the spectrum analyzer 305 (block 1405). The frequency scorer 505 then scores the emphasized frequencies in the specified bands of the spectrum (block 1410). The reference symbol determiner compares the emphasized frequencies in the specified bands to a reference database to determine a symbol value associated with the emphasized frequencies (block 1415). The reference symbol determiner 510 then sends the determined symbol value to the symbol buffer 315 for storage (block 1420).

Figure 15:
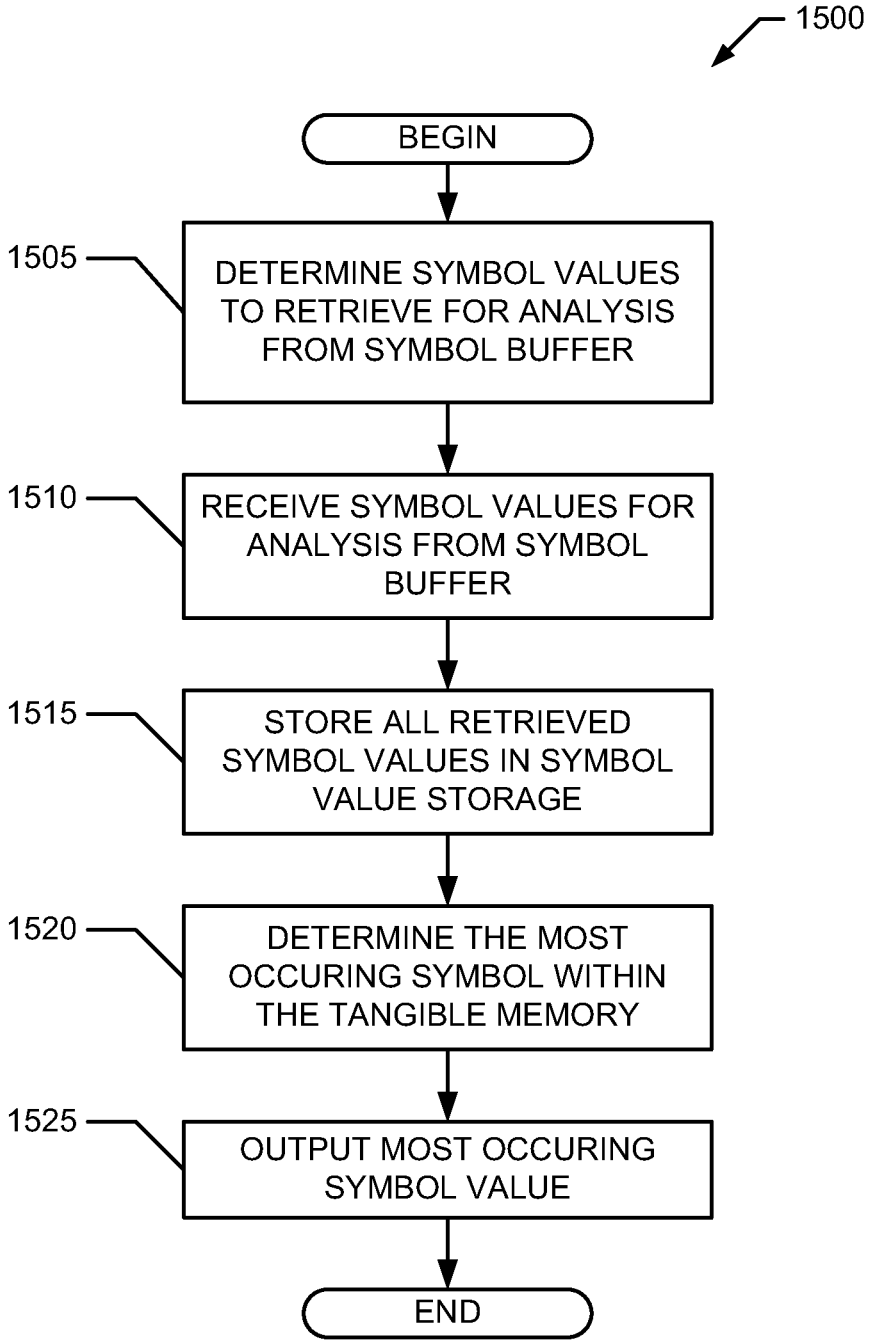
FIG. 15 is a flowchart representative of example machine readable instructions that may be executed to implement the example resulting symbol value determiner of FIGS. 3 and/or 7.

FIG. 15 is a flowchart of example machine readable instructions 1500 that may be executed to implement the resulting symbol determiner 320 of FIGS. 3 and/or 7 and to implement block 1220 of FIG. 12. With reference to FIGS. 3 and/or 7, the example machine readable instructions 1500 of FIG. 7 when the resulting symbol determiner 320 determines a series of symbol values to retrieve for analysis from the symbol buffer (block 1505). The series of symbols to retrieve may be configured by an administrator of the resulting symbol determiner 320. For example, the user may indicate that the resulting symbol determiner 320 should consider the most recently identified symbol, the 9 symbols immediately preceding the most recently identified symbol, and the 10 corresponding symbols from each of preceding 3 messages. The set of symbol retrievers 705 retrieve the selected symbol values for analysis from the symbol buffer 315 (block 1510). The symbol retrievers 705 store all retrieved symbol values in the symbol value storage 710 (block 1515). The symbol voter 715 determines the most occurring symbol within the symbol value storage 710 (block 1520). The symbol voter 715 then outputs the most occurring symbol value to the message buffer 220 (block 1525).

Figure 16:
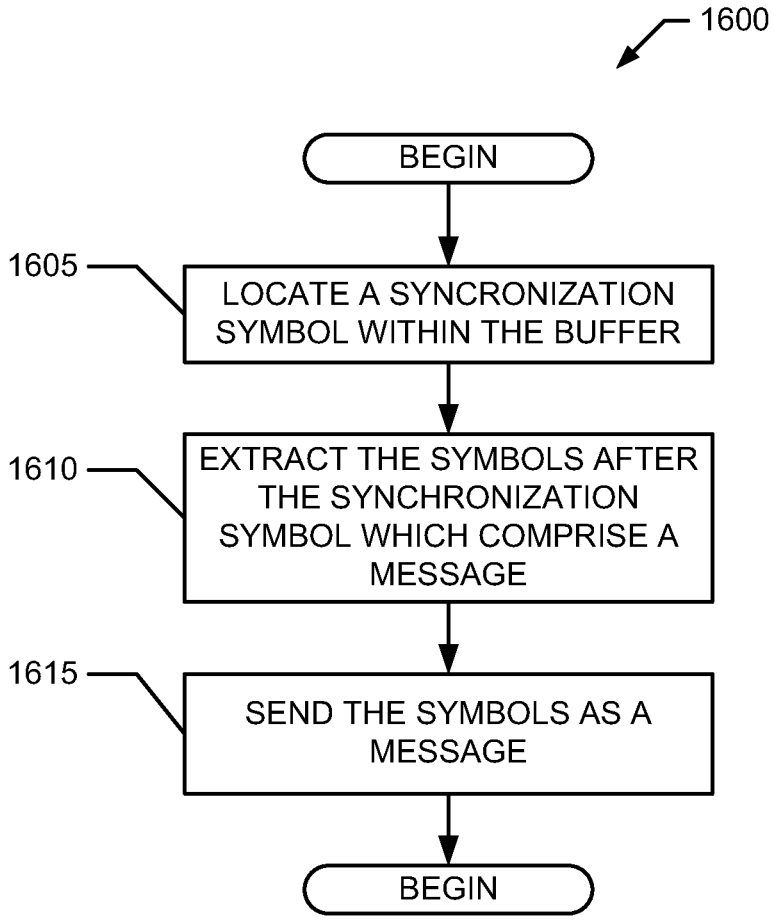
FIG. 16 is a flowchart representative of example machine readable instructions that may be executed to implement the example message identifier of FIG. 2.

FIG. 16 is a flowchart of example machine readable instructions 1600 that may be executed to implement the message identifier 225 of FIG. 2 and to implement block 1125 of FIG. 11. With reference to FIG. 2, the example machine readable instructions 1600 begin when the message identifier 225 locates a synchronization symbol within the message buffer 220 (block 1605). The message buffer 220 extracts the number of symbols of a message after the synchronization symbol (block 1610). The message identifier sends the extracted symbols to the symbol-to-bit converter 230 (block 1615).

Figure 17:
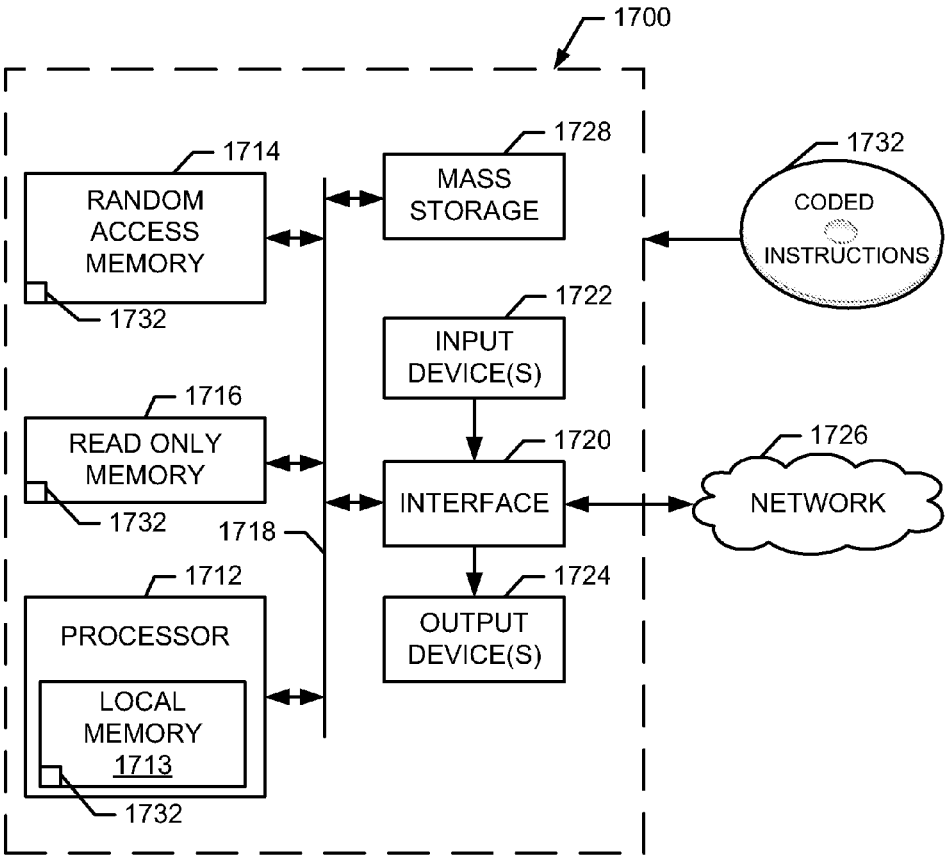
FIG. 17 is a block diagram of an example processing system that may execute the example machine readable instructions of FIGS. 11-15 and/or 16, to implement the example decoder of FIGS. 1 and/or 2, the example sampler of FIG. 2, the example sample buffer of FIG. 2, the example symbol value determiner of FIGS. 2 and/or 3, the example spectrum analyzer of FIGS. 3 and/or 4, the spectrum analyzer of FIG. 4, the example slide spectrum buffer of FIG. 4, the example block analyzer 310 of FIGS. 3 and/or 5, the example frequency scorer of FIG. 5, the example reference symbol determiner of FIG. 5, the example symbol buffer of FIGS. 3 and/or 6, the example error detector of FIG. 6, the example circular symbol buffer of FIG. 6, the example resulting symbol determiner of FIGS. 3 and/or 7, the example symbol retrievers of FIG. 7, the example symbol voter of FIG. 7, the example message buffer of FIG. 2, the example message identifier of FIG. 2, and/or the example symbol-to-bit converter of FIG. 2.

FIG. 17 is a block diagram of an example processor platform 1700 capable of executing the instructions of FIGS. 11-16 to implement the apparatus of FIGS. 1-7. The processor platform 1700 can be, for example, a server, a personal computer, a mobile phone (e.g., a cell phone), a personal digital assistant (PDA), an Internet appliance, a DVD player, a CD player, a digital video recorder, a Blu-ray player, a gaming console, a personal video recorder, a set top box, or any other type of computing device.

The processor platform 1700 of the instant example includes a processor 1712. For example, the processor 1712 can be implemented by one or more microprocessors or controllers from any desired family or manufacturer.

The processor 1712 includes a local memory 1713 (e.g., a cache) and is in communication with a main memory including a volatile memory 1716 and a non-volatile memory 1714 via a bus 1718. The volatile memory 1716 may be implemented by Synchronous Dynamic Random Access Memory (SDRAM), Dynamic Random Access Memory (DRAM), RAMBUS Dynamic Random Access Memory (RDRAM) and/or any other type of random access memory device. The non-volatile memory 1714 may be implemented by flash memory and/or any other desired type of memory device. Access to the main memory 1714, 1716 is controlled by a memory controller.

The processor platform 1700 also includes an interface circuit 1720. The interface circuit 1720 may be implemented by any type of interface standard, such as an Ethernet interface, a universal serial bus (USB), and/or a PCI express interface.

One or more input devices 1722 are connected to the interface circuit 1720. The input device(s) 1722 permit a user to enter data and commands into the processor 1712. The input device(s) can be implemented by, for example, a keyboard, a mouse, a touchscreen, a track-pad, a trackball, isopoint and/or a voice recognition system.

One or more output devices 1724 are also connected to the interface circuit 1720. The output devices 1724 can be implemented, for example, by display devices (e.g., a liquid crystal display, a cathode ray tube display (CRT), a printer and/or speakers). The interface circuit 1720, thus, typically includes a graphics driver card.

The interface circuit 1720 also includes a communication device such as a modem or network interface card to facilitate exchange of data with external computers via a network 1726 (e.g., an Ethernet connection, a digital subscriber line (DSL), a telephone line, coaxial cable, a cellular telephone system, etc.).

The computer 1700 also includes one or more mass storage devices 1728 for storing software and data. Examples of such mass storage devices 1728 include floppy disk drives, hard drive disks, compact disk drives and digital versatile disk (DVD) drives. The mass storage device 1728 may implement the example sample buffer 210, the example message buffer 220, the example symbol-to-bit reference database 235, the example symbol buffer 315, the example slide spectrum buffer 410, the example reference symbol LUT 515, the example circular symbol buffer 610, the example symbol value storage 710, and/or any other storage element.

The coded instructions 1732 of FIGS. 11-17 may be stored in the mass storage device 1728, in the volatile memory 1714, in the non-volatile memory 1716, and/or on a removable storage medium such as a CD or DVD.

From the foregoing, it will be appreciated that the above disclosed methods, apparatus and articles of manufacture improves upon prior methods of decoding embedded codes by exploiting the redundancy in analyzing overlapping blocks of samples and/or by exploiting the redundancy of recurring symbols in messages consecutively encoded in media.

Although certain example methods, apparatus and articles of manufacture have been described herein, the scope of coverage of this patent is not limited thereto. On the contrary, this patent covers all methods, apparatus and articles of manufacture fairly falling within the scope of the claims of this patent.

What is claimed is:

1. A method for determining information embedded in media signals, the method comprising:

sampling, using a processor, a media signal to generate samples, wherein the media signal includes an embedded message;

determining, using the processor, a first symbol value based on a first frequency spectrum determined for a first block of the samples;

determining, using the processor, a second symbol value based on a second frequency spectrum determined for a second block of the samples; and determining, using the processor, a resulting symbol value, representative of a part of the embedded message, by voting based on the first symbol value for the first block of samples and the second symbol value for the second block of samples, wherein the first block and the second block partially overlap in time in the media signal.

2. The method as defined in claim 1, further including determining a third symbol value for a third block of the samples, the third block of samples being located a multiple of a length of an embedded message prior to the first block of samples, and wherein determining the resulting symbol value is also based on the third symbol value.

3. The method as defined in claim 2, further including determining a fourth symbol value for a fourth block of the samples, the fourth block of samples and the third block of samples partially overlap, and determining the resulting symbol value is also determined based on the third symbol value.

4. The method as defined in claim 1, further including determining a first plurality of symbol values for a first plurality of blocks of samples, each block in the first plurality of blocks of samples being located a multiple of a length of a message prior to the first block of samples, and determining the resulting symbol value is also determined based on the first plurality of symbol values.

5. The method as defined in claim 4, further including determining a second plurality of symbol values for a second plurality of blocks of samples, each member of the second plurality of blocks of samples partly overlapping a member of the first plurality of blocks of samples, and determining the resulting symbol value is also determined based on the second plurality of symbol values.

6. The method as defined in claim 1, further including determining a third symbol value from a third block of samples, and the resulting symbol value is also determined based on the third symbol value.

7. The method as defined in claim 6, wherein determining the resulting symbol value includes extracting a most occurring symbol value.

8. The method as defined in claim 7, wherein the most occurring symbol value is determined by voting.

9. The method as defined in claim 1, wherein the media signal is embedded with a plurality of messages, each message including a series of symbols.

10. The method as defined in claim 1, wherein the samples are stored in a buffer.

11. The method as defined in claim 10, wherein the buffer is a circular buffer.

12. The method as defined in claim 1, further including storing the first symbol value and the second symbol value in a tangible memory, wherein the processor reads the first symbol value and the second symbol value from the tangible memory when determining the resulting symbol value.

13. The method as defined in claim 12, wherein the tangible memory is a circular buffer.

14. The method as defined in claim 1, wherein the first symbol value and the second symbol value are determined by performing a spectral analysis on, respectively, the first block of samples and the second block of samples to determine the first symbol value and the second symbol value.

15. The method as defined in claim 14, wherein the spectral analysis is performed using a fast Fourier transform.

16. The method as defined in claim 1, wherein the media signal is an audio signal.

17. The method as defined in claim 16, wherein the embedded message is embedded as an audio watermark.

18. A system for identifying messages embedded within media signals, the system comprising:

a sampler to sample a media signal to generate samples, wherein the media signal includes an embedded message;

a first symbol value extractor to determine a first symbol value for a first block of the samples;

a second symbol value extractor to determine a second symbol value for a second block of the samples; and a processor to determine a resulting symbol value, representative of a part of the embedded message, based on the first symbol value and the second symbol value for the first and second block of the samples, wherein the first block of the samples and the second block of the samples partially overlap.

19. The system as defined in claim 18, further including a third symbol value extractor to determine a third symbol value for a third block of the samples, wherein the third block of the samples is located a multiple of a length of an embedded message prior to the first block of the samples, wherein determining the resulting symbol value is also based on the third symbol value.

20. The system as defined in claim 19, further including a fourth symbol value extractor to determine a fourth symbol value for a fourth block of samples wherein the fourth block of samples and the third block of samples partially overlap, wherein determining the resulting symbol value is also determined based on the third symbol value.

21. The system as defined in claim 18, further including a first plurality of symbol value extractors to determine a first plurality of symbol values for a first plurality of blocks of samples, wherein each block in the first plurality of blocks of samples is located a multiple of a length of a message prior to the first block of samples, wherein determining the resulting symbol value is also determined based on the first plurality of symbol values.

22. A tangible computer readable storage medium comprising instructions, which, when executed, cause a machine to at least:

sample a media signal to generates samples, wherein the media signal includes an embedded message;

determine a first symbol value for a first block of the samples;

determine a second symbol value for a second block of the samples; and determine a resulting symbol value, representative of a part of the embedded message, based on the first symbol value and the second symbol value for the first and second blocks of samples, wherein the first block and the second block are partially overlapped.

23. The tangible computer readable storage medium as defined in claim 22, wherein the instructions, when executed, further cause the machine to determine a third symbol value for a third block of the samples, wherein the third block of samples is located a multiple of a length of an embedded message prior to the first block of samples, wherein determining the resulting symbol value is also based on the third symbol value.

* * * * *